US008077050B2

(12) United States Patent
Smith

(10) Patent No.: US 8,077,050 B2
(45) Date of Patent: Dec. 13, 2011

(54) TRANSPORT SYSTEM EVALUATOR

(75) Inventor: Steven L. Smith, Buford, GA (US)

(73) Assignee: United Parcel Service of America, Inc., Atlanta, GA (US)

( * ) Notice: Subject to any disclaimer, the term of this patent is extended or adjusted under 35 U.S.C. 154(b) by 402 days.

(21) Appl. No.: 12/410,052

(22) Filed: Mar. 24, 2009

(65) Prior Publication Data

US 2010/0245105 A1 Sep. 30, 2010

(51) Int. Cl.
*G08B 21/00* (2006.01)

(52) U.S. Cl. ..... 340/669; 340/686.1; 340/5.1

(58) Field of Classification Search ..... 340/669, 340/686.1, 5.1, 531, 539.1, 436, 426.16, 340/426.1, 10.3, 5.2
See application file for complete search history.

(56) References Cited

U.S. PATENT DOCUMENTS

| | | | |
|---|---|---|---|
| 3,438,489 | A | 4/1969 | Cambomac et al. |
| 4,234,926 | A | 11/1980 | Wallace et al. |
| 5,347,274 | A | 9/1994 | Hassett |
| 5,433,311 | A | 7/1995 | Bonnet |
| 5,489,017 | A | 2/1996 | Bonnet |
| 5,497,140 | A | 3/1996 | Tuttle |
| 5,547,063 | A | 8/1996 | Bonnet |
| 5,638,461 | A | 6/1997 | Fridge |
| 5,684,705 | A | 11/1997 | Herbert |
| 5,719,771 | A | 2/1998 | Buck et al. |
| 5,737,438 | A | 4/1998 | Zlotnick et al. |
| 5,774,876 | A | 6/1998 | Woolley et al. |
| 5,892,441 | A | 4/1999 | Woolley et al. |
| 5,936,523 | A | 8/1999 | West |
| 5,971,587 | A | 10/1999 | Kato et al. |
| 6,005,211 | A | 12/1999 | Huang et al. |
| 6,112,166 | A | 8/2000 | Joosten |
| 6,249,227 | B1 | 6/2001 | Brady et al. |
| 6,285,916 | B1 | 9/2001 | Kadaba et al. |
| 6,294,997 | B1 | 9/2001 | Paratore et al. |

(Continued)

FOREIGN PATENT DOCUMENTS

CA 2345763 A1 4/2000

(Continued)

OTHER PUBLICATIONS

"*DHL and Partners Develop RFID Sensor for Pharma Industry*," Freight e-Business News & Resources, Dec. 21, 2006, http://www.eyefortransport.com/print.asp?news=54063.

(Continued)

*Primary Examiner* — Daniel Previl
(74) *Attorney, Agent, or Firm* — Alston and Bird LLP

(57) ABSTRACT

An evaluating apparatus arranged to evaluate an item-transport system having a flow path. The apparatus includes one or more position markers adjacent the path and an evaluating device for sensing the markers and conditions of the transport system. The evaluating device has at least one evaluation sensor configured to (A) sense conditions of the transport system and (B) produce evaluation-sensor data based on the sensed conditions. The evaluating device also has a position-marker sensor configured to sense the position markers and produce position-marker data. The apparatus further includes a distance meter configured to produce distance data and at least one computing device configured to determine a particular location at which the evaluating device was along the path of the item-transport system when a particular condition of the item-transport system was sensed based on the evaluation-sensor data, the position-marker data, and the distance data.

32 Claims, 2 Drawing Sheets

U.S. PATENT DOCUMENTS

| | | | | |
|---|---|---|---|---|
| 6,473,169 | B1 | 10/2002 | Dawley et al. | |
| 6,483,434 | B1 | 11/2002 | UmiKer | |
| 6,496,806 | B1 | 12/2002 | Horwitz et al. | |
| 6,539,360 | B1 | 3/2003 | Kadaba | |
| 6,557,758 | B1 | 5/2003 | Monico | |
| 6,712,276 | B1 | 3/2004 | Abali et al. | |
| 6,720,888 | B2 | 4/2004 | Eagleson et al. | |
| 6,721,617 | B2 | 4/2004 | Kato et al. | |
| 6,820,022 | B2 | 11/2004 | Popp et al. | |
| 6,889,814 | B2 * | 5/2005 | Cerutti et al. | 198/358 |
| 6,892,512 | B2 | 5/2005 | Rice et al. | |
| 6,919,803 | B2 | 7/2005 | Breed | |
| 6,944,574 | B2 | 9/2005 | LeBlanc et al. | |
| 6,988,610 | B2 | 1/2006 | Fromme et al. | |
| 7,009,517 | B2 | 3/2006 | Wood | |
| 7,035,856 | B1 | 4/2006 | Morimoto | |
| 7,047,153 | B2 | 5/2006 | Woods et al. | |
| 7,130,709 | B2 | 10/2006 | Popp et al. | |
| 7,130,710 | B2 | 10/2006 | Popp et al. | |
| 7,143,087 | B2 * | 11/2006 | Fairweather | 707/770 |
| 7,149,658 | B2 | 12/2006 | Kadaba | |
| 7,154,596 | B2 | 12/2006 | Quist | |
| 7,162,319 | B2 | 1/2007 | Popp et al. | |
| 7,454,315 | B2 | 11/2008 | Kadaba | |
| 2002/0098272 | A1 | 7/2002 | Silver | |
| 2002/0106273 | A1 * | 8/2002 | Huang et al. | 414/788.1 |
| 2003/0014143 | A1 | 1/2003 | Kato et al. | |
| 2003/0101069 | A1 | 5/2003 | Sando | |
| 2003/0146836 | A1 | 8/2003 | Wood | |
| 2003/0163287 | A1 | 8/2003 | Vock et al. | |
| 2004/0008123 | A1 | 1/2004 | Carrender et al. | |
| 2004/0024644 | A1 | 2/2004 | Gui et al. | |
| 2004/0049315 | A1 | 3/2004 | Sansone et al. | |
| 2004/0100379 | A1 | 5/2004 | Boman et al. | |
| 2004/0124977 | A1 | 7/2004 | Biffar | |
| 2004/0143354 | A1 | 7/2004 | Kato et al. | |
| 2004/0149826 | A1 | 8/2004 | Alleshouse | |
| 2004/0193449 | A1 | 9/2004 | Wildman et al. | |
| 2004/0243353 | A1 | 12/2004 | Aghassipour | |
| 2004/0257203 | A1 | 12/2004 | Maltsev et al. | |
| 2005/0073406 | A1 | 4/2005 | Easley et al. | |
| 2005/0080566 | A1 | 4/2005 | Vock et al. | |
| 2005/0099292 | A1 | 5/2005 | Sajkowsky | |
| 2005/0116034 | A1 | 6/2005 | Satake et al. | |
| 2006/0109106 | A1 | 5/2006 | Braun | |
| 2010/0245105 | A1 | 9/2010 | Smith | |

FOREIGN PATENT DOCUMENTS

| | | | |
|---|---|---|---|
| EP | 0 996 105 | A1 | 4/2000 |
| WO | WO 00/19392 | A1 | 4/2000 |
| WO | WO 02/26566 | | 4/2002 |
| WO | WO 2005/022303 | A3 | 3/2005 |

OTHER PUBLICATIONS

"*Deutsche Post World Net Starts "DHL Innovation Initiative*" with IBM, Intel, Philips, and SAP," *DHL Press Release*, Feb. 16, 2008, DHL International GmbH.

"*DHL Time/Temperature Recording Belgium*," *RFID for Courier and Postal Services*, May 2004, IDTechEx Ltd.

"*DHL and Partners Develop Rfid Sensor Solution for the Pharmaceutical Industry*," *DHL Press Release*, Dec. 20, 2006, DHL International GmbH.

Alien Technology, "2450 MHz Long Range Backscatter RFID System," website article, 6 pages, Jan. 29, 2004; http://liveweb.archive.org/http://www.alientechnology.com/index.php?option=displaypage&Itemid=61&op=p.&SubMenu=.

Auto ID Center, "Auto-ID on the Move: The Value Of Auto-ID Technology in Freight Transportation," Accenture White Pages, pages Cover, 1-26, Nov. 1, 2002, Distribution Restricted to Sponsors Until Feb. 1, 2003, Cambridge, Massachusetts.

Fedex Custom Critical, "FedEx Custom Critical Launches TEMP-ASSURE Validated[SM]," Press Release, 1 page, Feb. 4, 2004, Akron, Ohio.

Syscan International Inc., "New RFID Based Solution for Perishable Products," Accelerating Business Efficiency, 1 page, May 20, 2003, Montreal, Quebec.

Sharp, "In Supply Chain Applications Such As Food Safety Monitoring, ADC Devices Go Beyond Mere Identification To Report On The World Around Them," a Sense of The Real World, 5 pages.

Shreiner, "E-temp-label," Website Article from www.schreiner-online.com/en/html/gb/medipharm/e-temp-label.htm#, Nov. 29, 2003, 3 pages.

Sensitech, "Cold Chain Market Shipment Logistics System," Website Article from www.sensitech.com, pp. 13-15, 2001, Beverly, Massachusetts.

Matrics Group, "Rfid Products," Website Article from http://HYPERLINK "http://www.matricsgroup.com/rfid.asp" www.matricsgroup.com/rfid.asp, Dec. 13, 2001.

RFID Journal, "New Low-cost Temperature Sensor," Website Article from ww.rfidjournal.com/article/articleview/28/1/1/, Jul. 19, 2002.

Sharp, Kevin R., "A Sense of the Real World," Website Article from www.scs-mag.com/reader/2000_09/sens0900/, Sep. 2000.

Davie, A. "*Intelligent Taging for Transport and Logistics: The ParcelCall Approach*," Jun. 2002, Electronics & Communication Engineering Journal, pp. 122-128.

Office Action dated Jun. 6, 2005 of U.S. Appl. No. 10/770,119.

Final Office Action dated Oct. 18, 2005 of U.S. Appl. No. 10/770,119.

Office Action dated Apr. 4, 2006 of U.S. Appl. No. 10/770,119.

Notice of Allowance dated Aug. 7, 2006 of U.S. Appl. No. 10/770,119.

Office Action dated Oct. 1, 2008 of U.S. Appl. No. 11/552,173.

Final Office Action dated Mar. 16, 2009 of U.S. Appl. No. 11/552,173.

Office Action dated Aug. 11, 2009 of U.S. Appl. No. 11/552,173.

Final Office Action dated Feb. 3, 2010 of U.S. Appl. No. 11/552,173.

Office Action dated May 17, 2010 of U.S. Appl. No. 11/552,173.

Notice of Allowance dated Sep. 13, 2010 of U.S. Appl. No. 11/552,173.

Supplemental Notice of Allowance dated Dec. 23, 2010 of U.S. Appl. No. 11/552,173.

Office Action dated Nov. 8, 2007 of U.S. Appl. No. 11/552,413.

Office Action dated Apr. 16, 2008 of U.S. Appl. No. 11/552,413.

Notice of Allowance dated Jul. 16, 2008 of U.S. Appl. No. 11/552,413.

Office Action dated Jul. 26, 2010 of U.S. Appl. No. 12/251,771.

Notice of Allowance dated Dec. 17, 2010 of U.S. Appl. No. 12/251,771.

Office Action dated Jul. 10, 2009 of related Canadian Application No. 2,554,871.

Office Action dated Mar. 2, 2010 of related Canadian Application No. 2,554,871.

Office Action dated Dec. 30, 2010 of related Canadian Application No. 2,554,871.

Office Action dated Sep. 20, 2007 of related European Application No. 04 789.481.1.

Office Action dated Feb. 11, 2010 of related European Application No. 04 789.481.1.

Office Action dated Mar. 20, 2009 of related Chinese Application No. 200480042301.5. (English Translation).

Office Action dated Feb. 5, 2010 of related Chinese Application No. 200480042301.5. (English Translation).

Office Action dated Aug. 13, 2010 of related Chinese Application No. 200480042301.5. (English Translation).

International Search Report and Written Opinion mailed Jan. 19, 2005 of related international application No. PCT/US2004/032470.

International Preliminary Report on Patentability mailed Jan. 10, 2006 of related international application No. PCT/US2004/032470, and Written Opinion mailed Jan. 19, 2005, of related international application No. PCT/US2004/032470.

* cited by examiner

TRANSPORT SYSTEM EVALUATOR

FIELD OF THE INVENTION

Various embodiments of the present invention relate to evaluating apparatuses and, more specifically, to apparatus for evaluating conditions associated with a package-handling system or other item-handling and/or conveyor systems.

BACKGROUND OF THE DISCLOSURE

Package-handling systems, such as those having conveyor belts, drive and guide packages or package-carrying bins or trays through warehouses and delivery hubs. These systems are often thousands of feet long and have hundreds of joints or interface points, such as turns or changes in elevation. Throughout such systems, and especially at interface points, system components from time to time operate improperly due to being misaligned or damaged. Parts such as bearings, guide components, and drive wheels may become misaligned or damaged undesirably by normal wear over time or improper loading. Because components operating improperly are often located in areas of limited access, it is often difficult to identify the problem and its location. There is a need for a package-handling system evaluator for automatically identifying the presence and location of problems in the system.

Problems in the package-handling system are often in far reaches of the system. Thus, users of the system often do not notice the problems until they worsen to the point of halting the system. Having the system down for a few hours or much longer for maintenance on these occasions may be very costly. It is also costly to repair more parts of the package-handling system then necessary in cases where the particular problem and/or facility or area in which the flow path is located area has not been pinpointed.

It is contemplated that users may perform preventative monitoring for identifying problems in their early stages, before they worsen. At early stages, though, slight vibrations or other indications of improper function are difficult or impossible to detect by casual observance. Even when problems are observable by a visual inspection, or identified using handheld sensors, it is a time consuming and costly endeavor for personnel to regularly walk around the entire system, which may be many miles long.

Manually monitoring item-transport systems, such as package-handling systems, on a continuous basis using people constantly inspecting the system may also be expensive. For example, considering that some package-handling systems may run continuously, monitoring personnel may be needed for most of the hours of a day and even perhaps for 24-hour monitoring. Moreover, personnel often cannot see certain aspects of the package-handling system during operation of the system, such as within tunnels or within other equipment of the package-handling systems through which packages move while being handled. Also, some portions of package-handling systems are not easily accessible by personnel and are preferably accessed only to upgrade equipment or fix a known problem.

An item-transport system evaluator that is able to automatically monitor the system and identify the location of potential problems would save time and cost. An evaluator that accurately identifies the location of the operational problems would allow dispatching of personnel to the exact portion of the system needing maintenance. Accurately knowing the exact location of the damage would be especially helpful when problems are in difficult-to-access locations, such as on a conveyor belt elevated ten or more feet above the ground.

BRIEF SUMMARY OF THE DISCLOSURE

Various embodiments of the present invention relate to an evaluating apparatus arranged to evaluate an item-transport system having a flow path. The apparatus includes one or more position markers adjacent the path and an evaluating device for sensing the markers and conditions of the transport system. The evaluating device has at least one evaluation sensor configured to (A) sense conditions of the transport system and (B) produce evaluation-sensor data based on the sensed conditions. The evaluating device also has a position-marker sensor configured to sense the position markers and produce position-marker data. The apparatus further includes a distance meter configured to produce distance data and at least one computing device configured to determine a particular location at which the evaluating device was along the path of the item-transport system when a particular condition of the item-transport system was sensed based on the evaluation-sensor data, the position-marker data, and the distance data.

Some embodiments of the present invention relate to a method for evaluating an item-transport system utilizing an evaluating apparatus including (i) one or more position markers positioned adjacent a flow path of the item-transport system, (ii) an evaluating device including at least one evaluation sensor and a position-marker sensor, (iii) a distance meter, and (iv) at least one computing device. The method includes transporting the evaluating device along the flow path through the item-transport system and sensing the position markers utilizing the position-marker sensor as the evaluating device is transported along the flow path to produce position-marker data. The method also includes measuring utilizing the distance meter at least one parameter selected from a group of parameters consisting of distance traveled by the evaluating device and speed of the evaluating device. The method also includes producing distance data based on the measured parameter. The method further includes determining in the computing device a particular location of the evaluating device along the flow path of the item-transport system at which a particular condition of the one or more conditions was sensed by considering the distance data, the evaluation-sensor data, and the position-marker data.

BRIEF DESCRIPTION OF THE DRAWINGS

Having described various embodiments of the invention in general terms, reference will now be made to the accompanying drawings, which are not necessarily drawn to scale, and wherein.

DETAILED DESCRIPTION OF THE DISCLOSURE

Various embodiments of the present invention will now be described more fully hereinafter with reference to the accompanying figures, in which some, but not all embodiments of the invention are shown. Indeed, this invention may be embodied in many different forms and should not be construed as limited to the embodiments set forth herein. Rather, these embodiments are provided so that this disclosure will satisfy applicable legal requirements. Like numbers refer to like elements throughout.

Overview

Various embodiments of the present invention are directed to an apparatus for evaluating an item-transport system or system transporting other items. The item-transport system defines one or more flow paths along which the items travel as they move through the system (e.g., on one or more conveyor belts of the system). The item-transport system may include a package-handling system. In operation of many package-handling systems, packages are positioned in transport bins or trays for being transported along the path through the system. The evaluating apparatus includes an evaluating device for collecting data about the item-transport system while the evaluating device is being handled by the system.

The evaluating apparatus includes location-determining components for determining location of the evaluating device when the evaluating device detects events of interest. An abnormal vibration in a particular part of the item-transport system is an example of an event of interest. The evaluating device includes one or more evaluation sensors for sensing events of interest. For example, in some embodiments of the present invention, the evaluating device includes an accelerometer configured to identify magnitudes of accelerations experienced by the evaluating device as the evaluating device moves through the item-transport system.

In one embodiment, the location-determining components include one or more position markers positioned adjacent the flow path of the item-transport system. The evaluating device of this embodiment has a position-marker sensor configured to sense the position markers when the evaluating device becomes disposed adjacent or near the position markers. In a particular embodiment, the position-marker sensor and the position markers are configured so that the sensor senses a marker only when the sensor moves within a pre-determined distance, such as a pre-determined radius of a position marker. A precise location at which the evaluating device was when it sensed an event of interest may be determined based on, for example, the position of the most recently sensed position marker and a distance that the device traveled between sensing the last marker and sensing the event. This and other processes for determining location of the evaluating device are described in more detail below.

Figure 1:
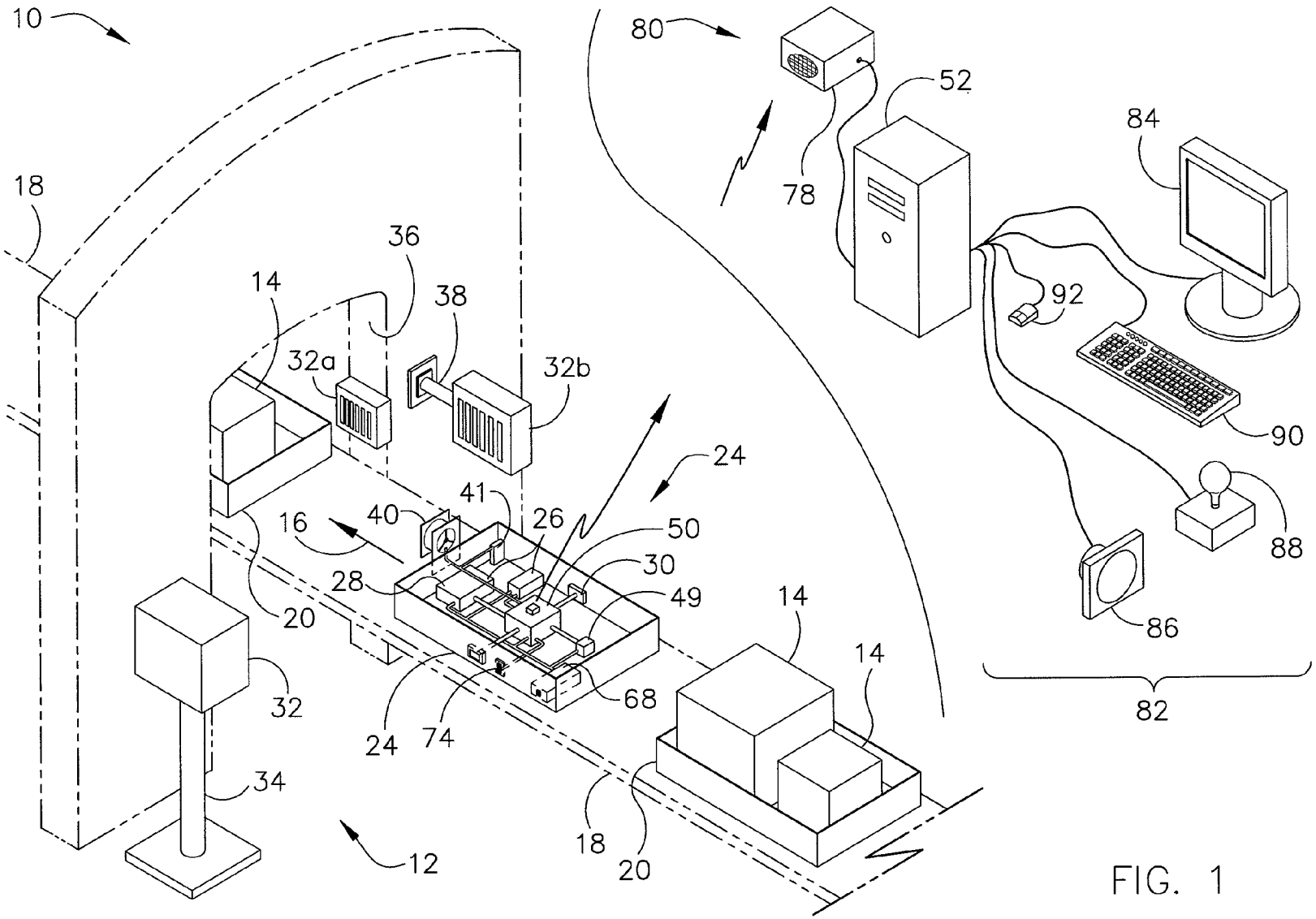
FIG. 1 is a perspective of an evaluating system according to a particular embodiment of the present invention shown in combination with an item-transport system.

Referring to the figures, and more particularly to FIG. 1, an evaluating apparatus according to a first embodiment of the present invention is designated by reference number 10. The evaluating apparatus 10, or evaluator, may be used to monitor a variety of transporting systems 12 without departing from the scope of the present invention. For example, as primarily described herein, the evaluating apparatus 10 may be used to monitor a system 12 handling items such as mail parcels or packages 14.

Although the evaluating apparatus 10 is primarily described in connection with such package-handling systems 12, the evaluating apparatus 10 is not limited to such use and may be used to evaluate other systems of transport. The techniques and apparatus 10 described herein may be used in other contexts, such as to evaluate systems transporting other items. For example, the techniques and apparatus 10 may be used to evaluate a luggage-handling system or a material-handling system such as those used to transport industrial and agricultural materials. As another example, the techniques and apparatus 10 may be used to evaluate systems transporting people, such as moving sidewalks, escalators, and elevators and other lifts (e.g., ski lifts).

Package-Handling System

The item-transport system, e.g., package-handling system 12, defines at least one flow path 16 along which the packages 14 are transported. The system 12 may include a conventional conveyor belt subsystem 18 defining at least a part of the flow path 16. The flow path 16 may also include package-carrying features such as rollers and slides (not shown). In a common type of package-handling system 12, packages 14 are held in transporting bins or trays 20 and the packages and trays are transported together through the package-handling system. Embodiments of the present invention described herein with reference to bins could instead include trays, and vice versa, and either could be replaced by other carrying structure. Package-handling systems 12 may convey packages at various speeds, some having maximum speeds of about one-thousand feet per minute.

Evaluating Device in General

In particular embodiments, the evaluating apparatus 10 includes an evaluating device 22. The evaluating device 22 includes an evaluating-device body 24. The evaluating-device body 24 may, but need not, generally resemble transport trays 20 in one or more ways. Similarities may include, for example, shape, size, material, weight, and weight distribution. In some embodiments, the evaluating device 22 includes one of the transport trays 20 used to transport packages 14 in operation of the package-handling system 12 as the evaluating-device body 24. The evaluating device 22 including the transport tray 20 may be sent through the package-handling system 12 for evaluating the system with or without packages 14 being disposed on the tray.

In one embodiment, the evaluating device 22 is configured to sense whether one or more packages 14 are disposed the tray. For example, the device 22 can be configured to sense when packages are loaded onto or unloaded from the tray 20. In one contemplated embodiment, the device 22 includes a weight or photo sensor configured and positioned to sense whether any packages are in the tray 20.

In various embodiments, the evaluating device 22, or a portion of the device, is configured to be selectively connected adjacent (e.g., to) and removed from a transport tray 20. For example, in a particular embodiment (not shown in detail) in which the evaluating device 22 includes a tray 20, the evaluating device includes one or more releasable fasteners, such as clips, screws, or clamps, for removably attaching a balance of the evaluating device (i.e., the components other than the body 24) to the tray. For example, regarding selective attachment of portions of the device 22, in one embodiment the local computing device 50 is removably attached adjacent the tray 20 or to a balance of the evaluating device 22 for purposes such as programming or otherwise configuring the local computing device, maintaining it, reading data stored thereon.

In some embodiments of the present invention, the evaluating device 22 is configured to monitor the package-handling system 12 while the system is handling transport trays, during normal operation of the system.

Evaluation Sensors

The evaluating device 22 includes one or more evaluation sensors 26 configured to sense characteristics associated with the package-handling system 12 or the evaluating device. The evaluation sensors 26 may include, but are not limited to sensors such as accelerometers, humidity sensors, cameras or other photo sensors, and gyroscopes. Informational output of the evaluation sensors 26 may be referred to as evaluation-sensor data.

The evaluating device 22 may include any one or more of a variety of sensors to sense characteristics of the package-handling system 12 and/or the evaluating device 22. As an example, an accelerometer 28 is shown in the figures and described herein. Other types of evaluation sensors 26 may be used instead of, or along with, an accelerometer to sense characteristics of the package-handling system 12 and/or the evaluating device 22. While characteristics of the accelerometer 28 are described, the same or analogous characteristics may apply to other evaluation sensors 26. For example, while a single accelerometer 28 is described herein for evaluating the package-handling system, multiple accelerometers may be arranged to perform the function without departing from the scope of the present invention. And multiple accelerometers may be replaced by a single accelerometer. The same is true for other evaluation sensors 26 referred to herein.

The same or analogous relationships between accelerometers 28 and other components of the apparatus 10 may exist between such components and non-accelerometers of the evaluation sensors 26. For example, where a computing device is described below collecting, storing, and processing data received from the accelerometer 28, the computing device may collect, store, and process data received from other evaluation sensors 26 for evaluating the package-handling system 12.

The accelerometer 28 may be connected adjacent (e.g., to) the body 24 of the evaluating device 22 in any of a variety of ways. While the accelerometer 28 may be connected to the body 24 in other ways without departing from the scope of the present invention, in one embodiment the accelerometer is mounted to the evaluating device by adhesive, screw, or nut and bolt.

The accelerometer 28 produces an accelerometer output signal having acceleration data. The accelerometer 28 may be configured to measure accelerations (e.g., positive and/or negative accelerations) experienced by the evaluating device 22 along one or more axes. In various embodiments of the present invention, the accelerometer 28 includes a three-axis accelerometer, a two-axis accelerometer, a single-axis accelerometer, or some combination of these. It is contemplated that the accelerometer 28 may include a memory and/or a processor (not shown in detail) to store and/or evaluate acceleration data before passing this data to another component of the evaluating apparatus 10.

Figure 2:
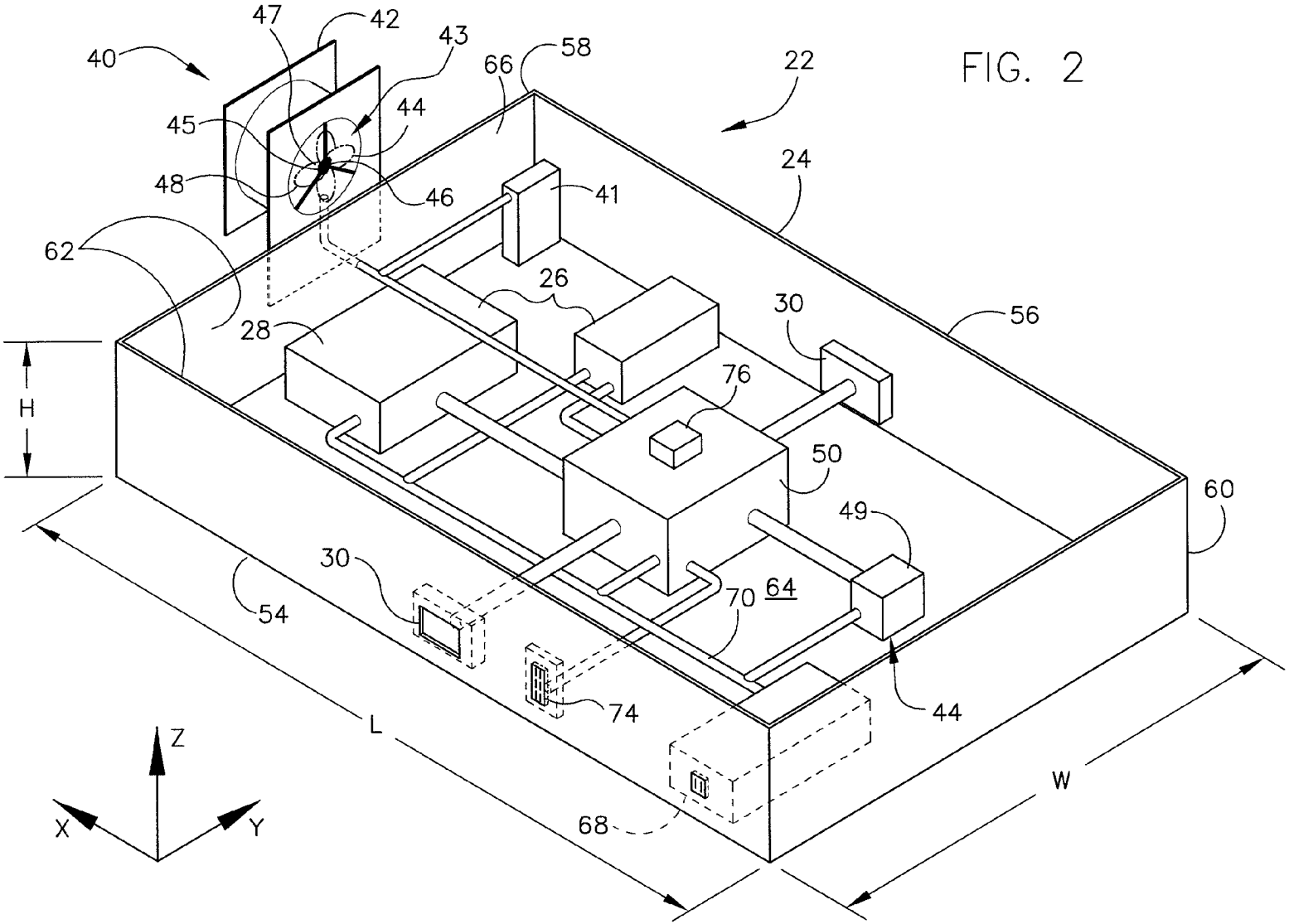
FIG. 2 is a perspective of an evaluating device of the evaluating system shown in FIG. 1.

Three-axis accelerometers, also known as triaxial accelerometers, are configured to measure accelerations along each of three orthogonal directions, labeled as x, y, and z in FIG. 2. Two-axis, or dual, accelerometers are configured to measure accelerations along two orthogonal axes, which may be referred to as the x and y, x and z, or y and z directions. Single-axis accelerometers are configured to measure acceleration along one of the axes. As an example of possible combinations and equivalents, three single-axis accelerometers oriented along the three axes are able to perform similar to a triaxial accelerometer and vice versa.

Where evaluation-sensor data has multiple components, such as data from a triaxial accelerometer having at least three data components corresponding to measurement along the three axes, the evaluating apparatus 10 may be configured to handle the components together or individually. For example, if an acceleration is sensed by the accelerometer 28 along the y axis of the evaluating device 22 above a predetermined threshold, or having other certain characteristics (e.g., pattern or time of occurrence), the evaluating apparatus 10 may be configured to store data including only the y-axis acceleration or to store all three acceleration components sensed at the time that the y-axis acceleration was sensed. Filtering and evaluating sensed conditions are described further below.

The accelerometer 28 may include a commercially-available device. The accelerometer 28 may be selected or configured to sense acceleration within a particular range, sometimes referred to as amplitude limit. Although the accelerometer 28 may be configured to sense accelerations within other ranges without departing from the scope of the present invention, in one embodiment of the present invention the accelerometer is configured to sense accelerations between about 0.25 g and about 10 g. In another embodiment the accelerometer 28 is configured to sense accelerations between about 0.5 g and about 8 g. Other variables that may be used in selecting or designing an accelerometer 28 include size, shape, weight, and weight distribution characteristics.

Because output signals from the evaluation sensors 26, such as analog signals from an accelerometer 28, may not always be sufficiently strong to be read, the evaluating device 22 may include one or more amplifiers (not shown). In some embodiments, the amplifier boosts the signal from evaluation sensor 26 and further transmits it to a destination, such as the local computing device 50.

Position Markers and Position-Marker Sensors

In various embodiments of the present invention, the evaluating device 22 includes at least one position-marker sensor 30 connected adjacent (e.g., to) the evaluating-device body 24 for sensing signs or position markers 32 positioned adjacent the flow path 16 of the package-handling system 12. The position-marker sensor 30 is configured and connected adjacent (e.g., to) the evaluating device 22 to sense the markers 32 while the evaluating device is moving within the package-handling system 12.

The position-marker sensor 30 produces position-marker data related to the sensed position markers 32. Position-marker data may include, for example, data about a position marker 32 being sensed or most recently sensed by the sensor 30. Position-marker data may also include information about all markers sensed by the position-marker sensor 30 sensor during a particular evaluation pass through the package-handling system 12. It is contemplated that the position-marker sensor 30 may include a memory and/or a processor to store and/or evaluate position-marker data before passing it to another component of the evaluating apparatus 10.

The position-marker sensors 30 may be configured to determine that the evaluating device 22 has passed each of the position markers 32 and when it has done so. The position-marker sensor 30 may also be configured to read information stored on the markers 32. Information stored on each position marker 32 may include, for example, a number or other identifying indicia or spatial coordinates of the marker. The spatial coordinates may include, for example, latitude and longitude or coordinates within the facility, such as the warehouse or package-delivery hub in which the system sits. Position marker information may also provide information about a section of a facility in which the position marker is located.

The position-marker sensor 30 may be connected to the evaluating-device body 24 in any of a variety of ways, such as by adhesive, screw, or nut and bolt. The position-marker sensor 30 is arranged on the evaluating device 22 so that it is able to sense position markers 32. For example, if position markers 32 are positioned along a left side of the flow path 16, the position-marker sensor may be positioned along a left side of the evaluating device 22. The evaluating device 22 shown in FIG. 2 has position-marker sensors 30 on both the right and the left of the evaluating device 22.

In one contemplated embodiment, the position-marker sensor 30 is connected adjacent the evaluating-device body 24 and/or configured so that at least some of the position-marker sensors move with respect to the body. For example, the position-marker sensor 30 may be connected to the evaluating-device body 24 or otherwise configured so that at least a part of the position-marker sensor pivots in one or more directions with respect to the evaluating-device body (not shown in detail). Being movable in this way allows flexibility for directing the position-marker sensor 30 toward the position markers 32 or any particular one or more position markers 32. Orientation of the sensor 30 may be controlled to, for example, ensure or increase the likelihood that the sensor will sense a position marker 32. The position-marker sensor 30 may be adjusted to better evaluate a package-handling system 12. It is also contemplated that the evaluating device 22 may include a small actuator (not shown in detail) for controlling orientation of the position-marker sensor 30 with respect to the evaluating-device body 24. The actuator may be controlled by an onboard computing device.

The position markers 32 may take any of a variety of forms. In one embodiment, at least one of the position markers 32 includes a bar code. In this embodiment, the position-marker sensor 30 includes a bar-code scanner for reading the bar code. The position markers 32 may also include a radio-frequency identification tag (RFID tag), and the position-marker sensor 30 includes a RFID scanner for reading the RFID tag. The RFID tag may be a passive or an active RFID tag, as well known in the art. In a particular embodiment, the position-marker sensor 30 (e.g., RFID scanner) and position markers 32 are configured so that the sensor senses the markers only when the sensor moves within a pre-determined distance, such as a pre-determined radius of one of the position markers.

In some embodiments, more than one position marker 32 is positioned in the same general area of the package-handling system 12. Positioning multiple markers 32 in the same vicinity ensures or increases the likelihood that at least one of the similarly-located markers will be sensed by a position-marker sensor 30 on the evaluating device 22 while the evaluating device is passing the markers. This redundant design strategy may be particularly helpful for embodiments of the present invention in which the exact orientation of the evaluating device 22 at the time that the evaluating device passes the markers 32 cannot be exactly determined.

The position markers 32 may be arranged adjacent the flow path 16 of the package-handling system 12 at a variety of positions and in any of a variety of ways without departing from the scope of the present invention. The position markers 32 may be positioned adjacent, and spaced along, the flow path 16 in a variety of ways. For example, the position markers 32 may be positioned above, below, and/or to the left or right sides of the flow path 16.

As shown in FIG. 1, the position marker 32 may be positioned on an upright or sign post 34 adjacent the flow path 16. The position marker 32 may also be connected directly to an existing part of the facility, such as a wall or ceiling (not shown). The marker 32 may alternatively be connected adjacent (e.g., to) a part of the package-handling system 12, such as position marker $\mathbf{32}_a$ shown in FIG. 1 mounted directly on an inner surface 36 of an arch of the system. FIG. 1 also shows a position marker $\mathbf{32}_b$ connected to the arch by way of a mounting brace or bracket 38.

In some more contemplated embodiments (not shown in detail), a position marker 32 may be positioned so as to surround a select portion of the flow path 16 at a particular location along the path, such as some, much, most, or all of the flow path at that location. For example, one or more position markers 32 may be arranged to cover all or a selected portion of a surface adjacent the flow path 16, such as the inner surface 36 of the arch shown in FIG. 1. Such positioning may be made to ensure or increase the likelihood that the position-marker sensor 30 will sense the position marker 32 as the evaluating device 22 is passing the marker.

As mentioned above, position markers 32 may be spaced along the flow path 16 of the package-handling system 12 in a variety of ways without departing from the scope of the present invention. The position markers 32 may be spaced in generally equal increments, such as every about 1,000 feet, 750 feet, 500 feet, 250 feet, etc. The position markers 32 may also be positioned at specific locations of the system 12, such as adjacent intersections, tunnels, etc. The evaluating apparatus 10 may include a position marker 32 at a beginning, or one or more of possible start points, and/or an end, or one or more possible end points, of the flow path 16 so that the apparatus senses it when the package has started and/or finished being transported in the system 12.

In some embodiments, a position marker 32 is positioned at the beginning and/or end of specified sections or tracks of the flow path 16. In these embodiments, the apparatus 10 may be adapted to determine that the evaluating device 22 is or was on a particular track at a particular time. The position marker 32 may, for example, include information read by the position-marker sensor 30 including a number or other identifying indicia of the section or track that the evaluating device 22 is entering when the marker is read.

As described regarding the accelerometer 28, because output signals from the position-marker sensor 30, such as analog signals, may not always be sufficiently strong to be read, the evaluating device 22 may include one or more amplifiers (not shown). In some embodiments, the amplifier boosts the signal from the position-marker sensor 30 and further transmits it to a destination, such as the local computing device 50.

Distance Meter

In various embodiments, the evaluating device 22 includes a distance meter 40 connected to the evaluating-device body 24. The distance meter may include a distance meter computing device for storing and/or processing data created by the meter. The distance meter 40 is configured to measure distance traveled by the evaluating device 22, or one or more properties contributing to a determination of distance traveled. The distance meter 40 produces a distance meter output signal including distance data. The distance data relates to distance traveled by the evaluating device 22, either by providing the distance traveled or providing a value or values of one or more parameters contributing to a determination of distance traveled during a period of time.

In various embodiments, the distance data includes a pulse or signal directly indicating a distance traveled by the evaluating device 22. In a particular embodiment, a computing device (e.g., computing device 50 described further below) of the evaluating device 22 is programmed to recognize that the evaluating device traveled a certain distance for every pulse received from the distance meter 40. For example, if the distance meter 40 is configured to produce a pulse for every foot of device travel and the computing device receives one-thousand pulses in a certain period of time, then the computing device would recognize that the evaluating device 20 traveled one-thousand feet during that period of time.

In some embodiments the distance meter 40 includes its own computing device and is configured to produce distance data including a speed of the evaluation device 22 or a distance, such as one-hundred feet. In some embodiments the distance meter is configured to output a signal indicating a speed or speeds at which the evaluating device 22 traveled during a period of time and a separate computing device (e.g., computing device 50, described further below) of the evaluating apparatus 10 is configured to determine the distance traveled based on the speed or speeds and the time in the period.

Whether the output of the distance meter 40 is distance, speed, or other parameter(s), the output of the distance meter may be referred to as distance data because it either directly indicates distance or indicates one or more parameters from which a distance traveled by the evaluating device 22 can be determined.

In some embodiments, the distance meter 40 determines speeds at which the evaluating device 22 moves by sensing speeds at which air passes by the evaluating device. These speeds may be processed in the distance meter 40, or output as distance data for later processing by a separate computing device, to determine distance traveled by the evaluating device 22. When the evaluating device 22 is moving through generally still air, the speed that air passes through and past the distance meter 40 is generally the speed at which the evaluating device 22 is moving along the flow path 16.

In one contemplated embodiment of the present invention, the evaluating apparatus 10 may include a compensating device (not shown) configured to sense characteristics of nearby moving air (e.g., drafts of air), such as speed or velocity of air, at one or more places along the flow path 16. The compensating device could be used with the evaluating device 22 whether the distance meter 40 is configured to output distance, speed, or other parameter related to distance traveled by the evaluating device. In the embodiment having a compensating device, the distance meter computing device 41 of the distance meter 40 or a processing device separate from the distance meter (e.g., computing device 50) is configured to take nearby air flows (e.g., drafts) into account when determining more accurate speed information. With the more accurate speed information, the distance meter computing device 40 or separate computing device is able to more accurately determine the distance traveled by the evaluation device 22. In one particular embodiment, the compensating device includes one or more stationary anemometers positioned adjacent the flow path 16 measuring air speed.

In some embodiments, the distance meter 40 preferably includes an air speed gauge such as an anemometer 42 connected adjacent (e.g., to) the evaluating-device body 24. In other applications, anemometers are commonly mounted outdoors in a stationary position to measure wind speed, such as at airports. In some embodiments of the present invention, the anemometer 42 is a commercially-available anemometer. While an anemometer 42 is the primary form of distance meter 40 described herein, other forms of distance meters may be utilized with or in place of the anemometer as described more below.

The anemometer 42 is configured and positioned on the body 24 so that air passes freely through the anemometer while the evaluating device 22 is moving forward. In the embodiment shown in FIGS. 1 and 2, the anemometer is mounted adjacent (e.g., to) a front or nose end 58 of the body 24 so that an air-passage 39 of the anemometer is disposed above the front wall 62 of the body.

In the embodiment shown in FIGS. 1 and 2, the anemometer 42 includes a rotating component 43 having a plurality of blades 44. The blades 44 are connected to each other by connecting structure 45 and arranged to freely rotate together. The blades 44 may be connected to and freely rotabably about an axle 46 as the connecting structure 45. In one contemplated embodiment (not shown), the blades 44 are connected together at a position between adjacent their base 47 and adjacent their tips 48. For example, the blades 44 could be connected at their bases 47 by a central axle 46. Or the blades 44 could be connected adjacent their tips 48 or somewhere mid-span between the tips and bases 47 by a shroud or other connecting structure. In various embodiments, it is preferred that the anemometer 42 is arranged on the evaluating device 22 so that an axis of rotation (e.g., axle 46) is aligned with the direction of the flow path (i.e., direction of forward travel of the device).

As the evaluating device 22 moves along the flow path 16, air moving against the blades 44 causes the blades, and thus the entire rotating component 43, to rotate. The faster the evaluating device 22 moves, the faster the rotating component 43 is caused to rotate.

In particular embodiments, the anemometer 42 includes rotation-sensing structure (not shown in detail) for sensing rotations of the rotating component 43. In some embodiments the rotation-sensing structure tracks full rotations or portions of rotations (e.g., ½, ¼, or less of a rotation) of the rotating component 43. The computing device 41 of the distance meter 40 or a separate computing device of the evaluating apparatus 10 (e.g., computing device 50) determines a distance that the evaluating device 22 has traveled in a particular period of time based, at least in part, on the number of rotations, or portions of rotations of rotating component 43 during that particular period of time.

In some embodiments, the distance meter computing device 41 of the distance meter 40 or separate computing device (e.g., computing device 50) is programmed with data associating an amount of rotation of the rotating component 43 with a distance traveled by the evaluating device 22. The distance meter computing device 41 or separate processor is thus able to determine that when the rotating component 43 has rotated a certain amount, the evaluating device 22 has traveled a certain corresponding distance along the travel path 16. For these embodiments, the data output of the anemometer 42 is a signal indicative of distance traveled by the evaluating device 22.

As mentioned above, the distance data may include pulses indicative of distance traveled by the evaluating device 22. For example, in designing and calibrating the evaluating apparatus 10, a designer or user of the apparatus may notice that the rotating component 43 rotates ten and one-half times for every foot that the evaluating device 22 moves along the flow path 16. In this example, the rotating component may be configured to produce a pulse every time the rotating component 43 rotates ten and one-half times. In this way, the computing device 41 of the distance meter 40 or separate computing device is easily able to determine distance traveled. For example, if one-thousand pulses are received from the anemometer 43, the computing device would recognize that the evaluating device 22 traveled one-thousand feet.

In some embodiments, the anemometer 42 is configured to produce pulses corresponding to rotation of the rotating component 43 and the computing device 41 of the distance meter 40 or a separate computing device of the evaluating apparatus 10 (e.g., computing device 50) is configured to determine a distance traveled by the evaluating device 22 based on the pulses. A designer or user of the system may configure the anemometer 42 to have a certain correlation between pulses and distance, which may be referred to as a pulse-to-distance correlation, or determine such correlation between pulses and distance through testing. Although the anemometer 42 may be configured to produce pulses having other correlations to distance traveled by the evaluating device 22, in one embodiment the anemometer is configured to produce one pulse for every about one foot traveled by the device.

In various other embodiments, the anemometer 42 is configured to measure a speed or speeds at which the evaluating device 22 moves for a period of time and to determine in the computing device 41 of the distance meter 40 a distance traveled corresponding to the speed or speeds at which the evaluation device moved during the time period. The distance data output from the anemometer 42 in these embodiments includes distance information or information directly indicative of distance. Distance data indicative of distance traveled by the evaluating device 22 includes one or more values that a separate computing device would be able to process to identify distance traveled by the device.

For embodiments in which the distance data includes speed and time information, the separate computing device would be configured to determine distance traveled by the evaluating device 22 in any of a variety of ways. In one embodiment, the separate computing device would be configured to determine distance traveled by (1) determining an average speed of the device 22 during a period of time and (2) multiplying the average speed by the time in the period, or:

$$D=V_{avg}\times T$$

where,

D=distance traveled during a time period;

$V_{avg}$=average velocity during the period; and

T=time elapsed in the period.

As mentioned, in some particular embodiments, the distance data includes speed information, such as a speed or speeds at which the evaluating device 22 has traveled during a particular period of time. For example, if the anemometer 42 senses that the evaluating device 22 has moved along the flow path 16 at an average speed of one-thousand feet per minute for thirty seconds, then a processor of the evaluating apparatus 10 (e.g., computing device 50) receiving the distance data including speed information from the distance meter 40 will determine that the evaluating device has traveled five hundred feet along the flow path during the thirty seconds, such as by using formula presented above.

In one contemplated embodiments of the invention, the computing device 41 of the distance meter 40 is configured to determine a distance that the evaluating device 22 has traveled by measuring accelerations of the evaluating device in the direction of travel along the flow path 16. In this embodiment, the distance meter 40 may be an accelerometer. In one particular embodiment, the accelerometer of the distance meter 40 is the same accelerometer 28 being a part of the evaluation sensor 26. The computing device 41 of the distance meter 40, or a separate processor (e.g., computing device 50) the processor may determine the distance traveled by the evaluation device over a particular path segment based, at least in part, on: (1) the speed at which the evaluation device was moving at the beginning of the segment; and (2) one or more accelerations measured by the accelerometer as the evaluation device traveled along the segment. One skilled in the art would readily understand how to perform these calculations based on well-established principles of physics.

The distance meter 40 including an accelerometer, or a processor receiving distance data, may obtain, from any of a variety of sources, a speed of the evaluating device 22 for determining the distance traveled by the evaluating device 22. For example, speed of the evaluating device 22 at the beginning of a segment may be obtained from another part of the evaluating device 22, such as the anemometer 42. As another example, the distance meter 40 including the accelerometer may use a speed at which the evaluating device was determined to have been moving at an end of a most recent previous segment as the starting speed for the present segment.

In one contemplated embodiment in which the distance meter 40 measures speed of the evaluating device 22, the evaluating apparatus 10 is configured to reset or update the distance meter 40 to more accurately determine the speed of the evaluating device 22. For instance, the computing device 41 of the distance meter or a separate processor of the apparatus 10 may be configured to calibrate the distance meter 40. As an example, if an accelerometer as the distance meter 40 indicates that the evaluating device 22 is moving at a very slight speed at a time when it is known that the device is momentarily not moving, then the distance meter 40 could be reset or updated by the computing device 41 or separate computing device to recognize the speed of the evaluation device as essentially zero at the time. Thereby, measurements of speed of the evaluating device 22 at the time and following the update would be more accurate. Or if an anemometer 42 as the distance meter 40 senses a speed at about 1% above or below an actual speed at which packages 14 must travel in a location, then the computing device 41 of the distance meter or a separate computing device can correct the anemometer based on the identified inaccuracy, so that speeds determined utilizing the adjustment are more accurate.

In some embodiments of the present invention the distance meter 40 includes a timing unit 49 connected to the evaluating-device body 24. And in some embodiments, the timing unit 49 is not a part of the distance meter 40. The timing unit 49 is configured to measure elapsed time and may include a commercially-available timing device. In some embodiments, the timing unit 49 is configured to track or count time in seconds or other units of time. The timing unit 49 may measure time in an increment selected by the designer of the system. For example, the timing unit 49 may be configured to count or produce one pulse every second, or one pulse every five seconds. And the timing unit 49 may measure and store an elapsed time count and output corresponding time data upon request from another device, such as one of the apparatus computing devices described more below.

In various embodiments of the present invention, the timing unit 49 may be configured so that the time data includes an amount of time that has elapsed since the evaluating device 22 was first introduced into or started moving within the system. The timing unit 49 may also be configured to produce time data representing an amount of time that has elapsed since the evaluating device 22 passed a position marker 32. As described further below, the apparatus 10 may also be configured to measure such elapsed times using information from the timer.

The timing unit 49 may comprise any of a variety of timers, such as a digital timer. The timing unit 49 may include a timer such as those used in conventional computing devices. Manners by which data from the timer is used to determine a distance traveled by the evaluating device 22 is described in further detail in the Determining Device Location section below.

Computing Device

As shown in FIGS. 1 and 2, the evaluating device 22 may also include a computing device 50. The particular type of computing device 50 may depend on any one or more variables including cost, weight, processing speed, storage capacity, and functions that a designer or user of the evaluating apparatus 10 would prefer to have performed local to the evaluating device 22. The designer may prefer to have some functions performed remote to the evaluating device 22. As shown in FIG. 1, the evaluating apparatus 10 may also include a remote computing device 52 separate from the evaluating device 22.

The local computing device and remote computing device 50, 52 may include any one or more of a variety of computing devices, such as a programmable logic controller (PLC) or a central processing unit (CPU). The remote computing device 52 may include a more complicated server or network of more than one of these devices.

The local computing device 50 may be operatively connected to the evaluation sensors 26 and the location-determining components of the evaluating device 22. For example, in an embodiment of the present invention having the following parts, the local computing device 50 may be operatively connected to the accelerometer 28, the position-marker sensor 30, and the distance meter 40 for receiving acceleration data, position-marker data, and distance data, respectively.

As mentioned, the distance meter 40 in some embodiments of the present invention includes the timing unit 49. In a particular embodiment, the timing unit 49 is a part of the local computing device 50. The evaluating device 22 may also include a device providing the current time (e.g., 9:15:33 a.m. (and date)). This current-time device may be a part of the distance meter 40 and/or local computing device 50 and may be, or share parts with, the distance meter 40. In some embodiments, the current-time device is configured to provide a time stamp. The evaluating apparatus 10 may be configured to associate a time stamp with a sensed acceleration or accelerations by storing the stamp in memory of the computing device 50, 52 in connection with information about the accelerations and corresponding location at which they were measured. The computing device of the distance meter 40 and/or the local computing device 50 may measure time and/or provide current time.

Because the local computing device 50 may be configured to collect data including receiving and perhaps also storing data, the local computing device may also be referred to as a data collector. Functions or features described herein as being performed by or of either computing device 50, 52 may apply to the other to the extent possible. For example, particular functions such as storing or processing described herein as being performed by the local or remote computing device 50, 52 may be performed by the other of the devices. References herein to the computing device 50, 52 or computing devices 50, 52 may be interpreted as the local computing device 50 and/or the remote computing device 52. Also, in some embodiments, one or more of the functions described as being performed by the computing device 41 of the distance meter 40 are performed by the local and/or remote computing devices 50, 52. In some embodiments, the computing device 41 of the distance meter 40 is configured to perform one or more of the functions described herein as being performed by one or both of the local and remote computing devices 50, 52.

Data Filtering

In various embodiments, the evaluating device 22 is configured so that only evaluation-sensor data having certain characteristics is sensed by one or more of the evaluation sensors 26. The evaluating device 22 may also be configured so that only evaluation-sensor data having certain characteristics is saved by or transferred from the one or more evaluation sensors 26 to the local computing device 50. Further, the evaluating apparatus 10 may be configured so that only evaluation-sensor data having certain characteristics is stored or processed by the local computing device 50 or the remote computing device 52. The computing device 50 may include a memory for storing data such as that received from the sensors 26, 30 and distance meter 40.

In some embodiments, the computing device 50 stores all of the sensor data. This data may be evaluated during or after the evaluating device 22 has moved through the package-handling system 12. Evaluating the data may include, for example, filtering the stored data based on select search criteria. For example, the stored data may be filtered by searching for acceleration data representing accelerations above a certain threshold value or having certain other characteristics, such as relatively rapid or successive accelerations below the threshold.

One such gatekeeper characteristic of evaluation-sensor data is value. In some embodiments, the evaluating device 22, or the evaluating apparatus 10 in general, is configured to act, or not act, on evaluation-sensor data depending on a value of a particular measurement, such as whether the value is above a threshold value or within a range of values. The designer or user of the apparatus 10 may select the value of a threshold value or range in a variety of ways. In various embodiments, the threshold value or range may be preselected through trials and/or experience analyzing the package-handling system 12.

For embodiments in which the evaluating device 22 includes an accelerometer 28, the threshold value regarding accelerations may be, for example, about 3 g. Alternatively, the threshold acceleration may be above or below 3 g, such as being at about 2 g, 2.5 g, 3.5 g, 4 g, etc. As an example of a threshold range for embodiments having the accelerometer 28, a designer or user of the evaluating apparatus 10 may identify a threshold range of between about 3 g and about 8 g.

In some embodiments of the present invention, by only sensing, transferring, or recording data at or above a threshold, or within a threshold range, the apparatus 10 is configured to not sense unimportant or uninteresting events. For example, because package trays 20 being handled by the system 12 regularly experience certain slight bumps and vibrations as they are transported through the system, it is advantageous in various embodiments to limit the sensed, transferred, or stored data to only data likely to be relevant.

The threshold value or range set in the apparatus 10 does not need to be the same with respect to all points in the item-transport system 12. In some embodiments, the threshold value or threshold range is different for various parts of the item-transport system 12. For example, the apparatus 10 (e.g., the computing device 50, 52) may be programmed to associate a specific lower threshold to one or more portions of the system 12 because item transport is expected to be especially smooth in the specific portion(s), and even slight accelerations may indicate a condition of interest, such as a problem or potential problem in the system 12. As another example, the apparatus 10 (e.g., computing device 50, 52) may be programmed to associate a specific higher threshold to one or more portions of the system 12 because the system usually moves packages in those portion(s) in ways (e.g., jostling) resulting in higher normal-operation accelerations.

As mentioned above, the evaluating device 22 may be configured to recognize certain sensed conditions, such as accelerations, as normal or expected accelerations caused by the package-handling system 12. During normal operation, the package-handling system may produce slight bumps or vibrations as the evaluating device 22 rounds curves or changes surface-types (e.g., from belt to rollers). The evaluating device 22 may also experience relatively rapid, though expected, yawing, rolling, or pitching, such as when the evaluating device transitions from a horizontal belt to a slide or an inclined belt.

In some embodiments, the threshold value or threshold range is set so that normal or expected accelerations are not sensed by the accelerometer 28, not transferred from the accelerometer (e.g., to an onboard computing device), and/or not stored by the apparatus 10. For example, in some embodiments of the present invention, all sensor data is transferred to the computing device 50, which stores the data. As mentioned above, stored data may be evaluated during or after the evaluating device 22 has moved through the package-handling system 12. Search criteria for filtering stored data may be arranged so that normal or expected accelerations are not selected.

In some embodiments of the present invention, advantages of limiting data in this way include saving time and cost of processing data that is apparently or likely unimportant. Such data may be referred to as noise. In some embodiments, processing avoided in this way includes storing, analyzing, and/or preparing a presentation of data.

Threshold values and ranges may be set or changed in a variety of ways. For example, the value or range may be programmed into the local computing device 50 and/or the respective evaluation sensor 26. The sensor 26, such as accelerometer 28, and/or the local computing device 50 may include one or more adjusters, such as a potentiometer, or "pot" (not shown).

In some embodiments filtering evaluation-sensor output, the apparatus 10 (e.g., computing device 50, 52) is configured to identify accelerations having certain characteristics such as a particular distribution. As mentioned above, the apparatus 10 may be configured to allow a group of accelerations having one or more particular characteristics through its filter even though one, more, of all of the accelerations in the group are below a threshold value or range. As provided above, an example of a particular characteristic is relatively rapid or successive accelerations.

As another example, the computing device 50, 52 may be programmed to recognize that certain accelerations indicate a specific condition of interest, such as a specific problem or a potential problem, considering their location within the item-transport system 12. A user or designer of the apparatus 10 may program the package-handling system 12 based at least in part on their experience with the system 12, such as with system operation and from trials. As an example, the computing device 50, 52 may be programmed to recognize that three relatively-rapid accelerations along the y axis of about 1 g at a position being a certain distance before a particular conveyor belt transition point (e.g., a point at which one belt meets another in the system 12) indicates a problem or potential problem with the system 12 in that area. The problem may be, for example, a misaligned belt or worn guide wheel. Identifying conditions such as problems and potential problems is described further below.

As referred to above, in some contemplated embodiments, the evaluating apparatus 10 is configured to anticipate or recognize expected spikes or other characteristics of evaluation-sensor data. In this embodiment, the apparatus 10 may treat such spikes as noise even though they are above the threshold or within a threshold range. In some embodiments, the apparatus 10 stores these expected evaluation-sensor data characteristics onboard the evaluating device 22, such as in the local computing device 50. Expected evaluation-sensor data characteristics may also be stored in the computing device 52 remote to the evaluating device 22. In some embodiments, evaluation-sensor characteristics may include, for example, spikes in acceleration or a particular profile of acceleration over a short period of time.

In various embodiments, data characteristics, such as accelerations, may be stored with distance data or other position-related data, and the evaluating device 22 and/or remote computing device 52 is configured to determine that a particular data profile, such as a relatively high acceleration, is part of normal operations considering the location of the evaluating device or time having elapsed since a certain event.

In one contemplated embodiment, the evaluating apparatus 10 (e.g., the computing device 50, 52) anticipates or recognizes an expected characteristic of evaluation-sensor data by recognizing characteristics of the particular data. For example, it may be determined in trials that when the evaluating device turns a certain corner along the flow path 16 of the system, accelerations having a particular magnitude and/or profile over a period of time are typically sensed. Thus, when this particular profile or particular magnitudes are sensed and recognized while evaluating the system 12, the apparatus 10 treats the events as noise.

Data Analysis

In various embodiments, the apparatus 10 (e.g., the computing device 50, 52) is configured to analyze characteristics of multiple accelerations occurring within a relatively short period of time or travel distance for the evaluating device 22 to identify the likely cause of, or relation between, the accelerations. The computing device 50, 52 may be programmed to accomplish this task. For example, the apparatus 10 may analyze multiple accelerations occurring within a two-second span to determine that the accelerations, though perhaps distinct in some ways, are being caused by a single problem (e.g., a misaligned belt or drive mechanism). The single problem may cause each of the separate accelerations directly, for example, or the single problem may directly cause one or more accelerations followed by a winding down of the evaluating device 22 from the direct stimulations, such as may occur when the evaluating device is rocking or otherwise settling back to a stable disposition.

In various embodiments of the present invention, the apparatus 10 is configured to determine location of the evaluating device 22 by processing any combination of position-marker data and distance data, which in some particular embodiments includes evaluating-device speed data and in some embodiments also time data. The evaluating-device speed data may include, for example, an actual, approximate, or average speed that the evaluating device was moving or is expected to have been moving along the flow path 16 in a particular section of the flow path (e.g., a section following a most recently sensed position marker).

The location determination may be made by a user of the evaluating apparatus 120, or automatically by the local and/or remote computing devices 50, 52. One or both computing devices 50, 52 may be configured to store evaluation-sensor data (e.g., acceleration data), position-marker data, and distance data for use in analyzing the package-handling system 10.

In various embodiments, location data is derived based in part on time data. For example, it may be determined, considering the package-transporting speed or speeds along the flow path 16 or a section thereof, that the evaluating device 22 travels three feet every second. Thus, in some embodiments, if the evaluating device 22 sensed an acceleration of interest about ten seconds after passing a second position marker, the computing device 50 or 52 would determine from the position-marker data, and distance data includes time data, and speed information, that the evaluating device was about thirty feet beyond the second position marker, the location of which is known, when the evaluating device sensed the acceleration of interest.

In some embodiments of the present invention, an average, approximate, or actual speed of the evaluating device 22 throughout the package-handling system 12, or various parts thereof, is determined by ways other than by anemometer 42. In one embodiment, the evaluating apparatus 10 obtains speed of the evaluating device 22 from the package-handling system 12. For example, in some embodiments the speed of the evaluating device 22 is inferred from a speed of the conveyor belt on which it is riding, and this speed is received by the apparatus 10 from the system 12. For example, if it known that the evaluating device 22 is being moved on a conveyor belt in a particular portion of the flow path moving at about one-thousand feet per minute, it may be inferred that the evaluating device 22 is moving at about one-thousand feet per minute while it is in that portion of the flow path. In one contemplated embodiment, the evaluating apparatus 10 determines speed in more than one way, and is configured to compare the speeds, and perhaps also to correct or adjust one or more of the speed-determining sources (e.g., anemometer 42, accelerometer 28, and/or package-handling system 12) based on determinations of data received from the other. For example, in one particular embodiment, speed of the evaluating device 22 determined from information from the package-handling system 12 is compared to speed determined by the distance meter 40 (e.g., anemometer 42), and each of these two speed determinations can be used to improve or correct the other determination in a present calculation or analysis and/or to improve accuracy of future determinations of speed.

The package-handling system 12 includes a sensor or group of sensors other than the anemometer in some embodiments. For example, the package-handling system 12 may include one or more sensors, such as radar or camera sensors, for determining speed of the evaluating device 22. In one contemplated embodiment, the evaluation device 22 is configured to compare the speeds from such other sensors to each other or to speeds determined by the anemometer or other ways. And, as mentioned above regarding another embodiment, the apparatus 10 of these embodiments may be configured to improve or correct the source of one of the speed determinations based on the other determination for improving present and/or future determinations of evaluating device 22 speed.

In some embodiments, the speed or speeds of the evaluating device along the flow path 16 or portions thereof is programmed into the local and/or remote computing device 50, 52 so that the computing device(s) is able to easily determine an expected speed or speed profile of the device 22 between any particular two markers 32 or other defined portion of the flow path 16 (e.g., between a marker #4 and 50 feet beyond that marker). And again for these embodiments as in previously described embodiments, the evaluation device 22 may be configured to compare the speeds from various sources and improve or correct one of the sources based on readouts of another of the sources.

Determining Device Location

In various embodiments, the evaluating apparatus 10 is configured to create and process acceleration data, position-marker data, distance data, time data, and/or speed data in any of a variety of ways to determine or approximate the location at which the evaluating device 22 is or was beyond a most recently sensed marker 32 when it sensed a system characteristic of interest (e.g., an acceleration of interest). As mentioned above, the distance data may include distance, time, and/or speed information.

In various embodiments of the present invention, location of the evaluating device 22 is determined using position-marker data and distance data. As described, the distance meter 40 outputs distance data in any of various forms including distance information and speed information, and in some embodiments time information is a part of distance data with distance and/or speed information.

In embodiments in which distance data includes one or more parameters other than distance, a separate computing device (e.g., computing device 50) determines the travel distance of the evaluating device 22 corresponding to the distance data parameter(s) provided. For instance, as mentioned, the evaluating device 22, and the distance meter 40 in particular, may be configured to provide distance data indicating speed information and corresponding time information. From this distance data, a separate computing device (e.g., computing device 50) is able to determine distance traveled by the evaluating device 22 during the time period. For example, as mentioned above, the separate computing device could be configured to determine distance traveled by the evaluating device 22 in ways including by (1) determining an average speed of the device 22 during a period of time and (2) multiplying the average speed by the time in the period, or:

$$D=V_{avg}\times T$$

where,

D=distance traveled during a time period;

$V_{avg}$=average velocity during the period; and

T=time elapsed in the period.

For example, if the distance data indicates that the evaluating device 22 moved along the travel path 16 at a constant or average speed of one-thousand feet per minute for thirty seconds, then the separate computing device would determine that the evaluating device traveled five-hundred feet during the thirty seconds (i.e., 1,000 ft/s×0.5 s=500 ft). Of course, if the evaluating device 22 moves at a constant speed during a period of time, then that speed would be the average speed.

Thus, for example, if an event of interest such as an acceleration spike was sensed by the evaluation sensor 26 thirty seconds after the position-marker sensor 30 sensed the most recent position marker 32 passed by the evaluation device 22, the computing device would analyze the speed data corresponding to this thirty-second time period to determine the distance traveled between the most recent marker and location of the event.

As described herein, the evaluating apparatus 10 may determine a distance traveled by the evaluating device 22 using time data. In some embodiments, the time data is a part of the distance data output by the distance meter 40 and processed by the distance meter or separate computing device with speed obtained by the distance meter or otherwise (e.g., from the package-handling system 12) to determine distance traveled by the evaluating device.

In some embodiments, the evaluating apparatus 10 processes time data, position-marker data, and/or speed data to determine a time having elapsed since the evaluating device 22 passed a most recent known location, such as a location adjacent a particular position marker 32, which time may be referred to as an offset value. Five contemplated embodiments for determining location of the evaluating device 22 using time and position-marker data are summarized here and described in further detail below:

(i) time data, including an amount of time having elapsed since the most recent position marker 32 was sensed by the evaluating device 22, is continuously provided to the local computing device 50 and new position-marker data is provided to the local computing device 50 to replace old position-marker data whenever a marker is sensed by the evaluating device 22;

(ii) time data, including a continuous count since an introduction of the evaluating device 22 to the system 12, is continuously provided to the local computing device 50 and new position-marker data is provided to the local computing device;

(iii) the timing unit 49 maintains a continuous count and sends time data corresponding to the count to the local computing device 50 upon receiving a signal from the local computing device or the position-marker sensor 30 indicating that a position marker 32 was sensed by the evaluating device 22;

(iv) position-marker data is provided to the timing unit 49, which in turn continuously provides time data to the local computing device 50 in a format indicating the most recent position marker 32 sensed by the evaluating device 22; and (v) the timing unit 49 keeps clock time and provides this time to the local computing device 50 as a time stamp each time a position marker 32 is sensed and each time an event of interest is sensed or each time evaluation-sensor data is provided to the computing device 50.

A designer or user of the evaluating apparatus 10 may arrange the apparatus to process time data and position-marker data in other ways to determine the time offset value and the identity of the most recently-passed marker 32 without departing from the scope of the present invention. Various ways in which the evaluating apparatus 10 may be configured for identifying location of the evaluating device 22 are identified below.

In the first embodiment for processing time and marker data to derive the time offset value and the identity of the most recently-passed marker 32 (item (i), above), the timing unit 49 continuously provides to the local computing device 50 time data including the time that has elapsed since the most recent position marker 32 was sensed by the evaluating device 22. In this embodiment, new position-marker data is provided to the local computing device 50 to replace old position-marker data in response to a marker being sensed by the evaluating device 22.

In this embodiment, the position-marker sensor 30 provides to the local computing device 50 updated position-marker data reflecting the most recent position marker sensed by the evaluating device 22. The position-marker sensor 30 or the local computing device 50 may be configured to send a signal to the timing unit 49 in response to a position marker 32 being sensed. When the timing unit 49 receives a signal indicating that a new marker was sensed, the timing unit resets and begins counting anew.

The evaluating apparatus 10 of the embodiment of item (i) may be configured so that the timing unit first starts counting (1, 2, 3, etc.) once the evaluating device is introduced to the package-handling system 12. For example, in some embodiments, the timing unit starts counting once a user or device flips a switch (not shown) to start the timer, or once a first position marker 32 is sensed by the position-marker sensor 30.

Further in this embodiment, the local computing device 50 is adapted to store the position-marker data in connection with a corresponding time data value. As an example, assume that the evaluating device 22 senses a particular acceleration of interest five seconds after the evaluating device has passed a second position marker 32. In this example, when the particular acceleration of interest is sensed, the local computing device 50 receives and stores the acceleration data along with the time data value (five seconds).

In various embodiments, the computing device 50 is also adapted to receive position-marker data, which may directly or indirectly indicate that the most recently sensed position marker was the second position marker 32. In some embodiments, the most recently sensed marker is indicated in one of at least two ways. The position marker-sensor may indicate that two position markers 32 have been sensed since the evaluating device 22 started moving in the system, or that the most recent position marker sensed was, particularly, the second position marker. For example, the sensor 30 or computing device 50 may have counted that it sensed two markers or the marker may have read identifying indicia (e.g., "marker 2") from the second marker.

As mentioned above, a distance at which the evaluating device 22 is along the flow path 16 beyond the most recently sensed position marker 32, may be determined by processing the time data and position-marker data (five seconds beyond the second marker in this example) along with an actual, approximate, or average speed, or speed that the evaluating device was or is expected to have been moving along the flow path after that most recently sensed position marker. For example, the apparatus 10 (e.g., the local computing device 50) may be configured to determine that if the evaluating device 22 was or is expected to have been moving along a section of the flow path after a most recently sensed position marker 32 at a speed of about three feet per second, and if the evaluating device 22 senses an acceleration of interest in this section about five seconds after the evaluating device sensed the last position marker 32, the acceleration was sensed about fifteen feet beyond that last marker. In some embodiments, speed information is received from the distance meter 40, such as anemometer 42. In some embodiments the speed information is obtained from another source, such as another sensor as described above (e.g., radar or camera sensors of the package-handling system 12).

As also mentioned above, where the speed of the evaluating device 22 is constant or generally constant, each count from the timing unit 49 would correspond to a certain distance travel for the evaluating device. Thus, for example, if the evaluating device is known to travel in a certain section of the system 10 at thirty feet every ten seconds, then each one second count of the timing unit 49 corresponds to three feet travel for the evaluating device 22 when it is in this section. Accordingly, if the evaluating device 22 senses an acceleration of interest in this section and five seconds after the evaluating device sensed the last position marker 32, the apparatus 10 (e.g., the local computing device 50) in some embodiments is configured to determine that the acceleration was sensed fifteen feet beyond that last marker.

In the second embodiment for processing time and marker data to determine time elapsed since the evaluating device 22 passed a marker 32 and the identity of that marker (item (ii), above), the timing unit 40 provides to the local computing device 50 time data including a continuous count from an introduction of the evaluating device to the package-handling system 12. In this embodiment, the position-marker sensor 30 provides to the local computing device 50 updated position-marker data reflecting the most recent position marker sensed by the evaluating device 22.

The evaluating apparatus 10 of this second embodiment may be configured so that the timing unit starts counting (e.g., 1, 2, 3, etc.) once the evaluating device 22 is introduced to the package-handling system 12. For example, in some embodiments, the timing unit 40 starts counting once a user or device releases the evaluating device 22 into the system and flips a switch (not shown) to start the timer, or when a first or start position marker 32 is sensed by the position-marker sensor 30.

In some forms of this second embodiment, the local computing device 50 stores the position-marker data with a corresponding time data value. For example, if the timing unit 40 has counted one-hundred and fifty seconds since the evaluating device 22 was introduced to the system when the fourth position marker is passed, the local computing device 50 stores these two values together. Then, if a particular acceleration of interest is sensed twenty seconds later, the local computing device 50 stores the acceleration data, the marker data, and timing data, including the time at which the most recent marker was sensed (e.g., one-hundred and fifty seconds after the evaluating device was introduced into the system) and the time at which the acceleration of interest was sensed (e.g., one-hundred and seventy seconds after the evaluating device was introduced into the system). From this data, the local or remote computing device 50, 52 determines that the acceleration occurred twenty seconds after the evaluating device 22 passed the fourth marker.

As described above, in some embodiments, a location of the evaluating device 22 along the flow path 16 beyond the most recently-sensed position marker 32 is determined by processing the time data and position-marker data (twenty seconds beyond the fourth marker in this example) along with an actual, approximate, or average speed that the evaluating device was or is expected to have been moving along the flow path after that most recently sensed position marker. Again, speed information may be found in the distance data output of the distance meter 40, such as anemometer 42 or from another source, such as one of those described above.

In the third embodiment for processing time and marker data to determine time elapsed since the evaluating device 22 passed a marker 32 and the identity of that marker (item (iii), above), the timing unit 40 maintains a continuous count and sends time data corresponding to the count to the local computing device 50 upon receiving a signal from the local computing device or the position-marker sensor 30 that a position marker was sensed by the evaluating device 22. The timing unit 40 may also be adapted to provide the current count value upon receiving a signal from the accelerometer 28 or local computing device 50 that an acceleration of interest was sensed. The evaluating apparatus 10 may be configured to recognize a signal from the position-marker sensor 30, accelerometer 28, or local computing device 50 as a request for time data. The timing unit 40 may be configured to maintain the count by creating, or creating and storing, the count.

For example, if the evaluating device 22 passes a first marker sixty seconds after being introduced into the package-handling system 12, the position-marker sensor 30 may provide position-marker data to the local computing device 50 indicating that the marker has been sensed. In some embodiments, the timing unit 40 may be notified that a first position marker was sensed in a variety of ways, such as directly from the position-marker sensor 30 or indirectly via the local computing device 50. Upon being notified that a position marker 28 has been sensed, the timing unit 40 is adapted to provide to the local computing device 50 time data corresponding to the most recent marker. For example, in this example, the computing device 50 would receive position-marker data from the position-marker sensor 30 indicating that a first marker 28 was sensed and timing data from the timing unit 40 indicating that the sixty seconds had elapsed between the evaluating device 22 being introduced to the system and that first marker being sensed. The local computing device 50 may store the position-marker data and time data together so that the time at which the evaluating device 22 sensed the particular marker may be easily determined in later analysis of the stored data.

Further in this example, if the evaluating device 22 senses an acceleration of interest two-hundred seconds since being introduced to the system, the accelerometer 28 is in some embodiments configured to provide acceleration data to the local computing device 50 indicating the acceleration of interest. In some embodiments, the timing unit 40 is notified of the acceleration of interest, for example, directly from the accelerometer 28 or indirectly from the local computing device 50. Upon receiving a signal indicating that the acceleration of interest was sensed, the timing unit 40 provides time data (two hundred seconds since being introduced to the system in this example) corresponding to the acceleration of interest to the local computing device 50. In embodiments using a timing unit 40 providing current times, the time data may include a time stamp of a current time at the moment that the acceleration of interest was sensed.

From this data, the local or remote computing device 50, 52 may determine that the acceleration of interest occurred one-hundred and forty seconds after the evaluating device 22 passed the first marker. As described above, a location of the evaluating device 22 along the flow path 16 beyond the most recently sensed position marker 32 may be determined by processing the time data and position-marker data (one-hundred and forty seconds beyond the first marker in this example) along with an actual or average speed, from any source, such as those described above, or speed that the evaluating device was or is expected to have been moving along the flow path 16 after the most recently sensed position marker.

In the fourth embodiment for processing time and marker data to determine time elapsed since the evaluating device 22 passed a marker and the identity of that marker (item (iv), above), the apparatus 10 is configured so that the position-marker data is provided to the timing unit 40. In some embodiments, the timing unit 40 receives the position-marker data from the position-marker sensor 30 directly or indirectly, such as via the local computing device 50. After receiving the position-marker data, the timing unit 40 integrates the data into its time count. The timing unit 40 may be configured to change its time count to reflect the most recently sensed position marker in a variety of ways, including those described in the following paragraphs.

In one contemplated particular embodiment, the timing unit 40 integrates the position-marker data into its time count by restarting counting each time new position-marker data is received and adding indicia to the count, or a record of the count, indicating the most recent position-marker passed. For example, after being first introduced to the package-handling system 12, the timing unit 40 may count or record as follows: 1, 2, 3, etc. After receiving position-marker data indicating that the first position marker 32 is being passed, the timing unit 40 may count as follows: 1', 2', 3', etc. The next count may be, for example, 1", 2", 3", etc. In this way, a time having elapsed since the evaluating device 22 last passed a position marker 32, and the identify of that position marker, may be determined by output data of the timing unit 40.

As another contemplated format for the timing unit 40 counting or recording time, the unit may first count as follows: 001, 002, 003, etc. In some embodiments, after the evaluating device 22 senses the next position marker, the timing unit 40, upon receiving notice that that next position marker was sensed, counts as follows: 101, 102, 103, etc. After the next marker 32 is sensed, the count may be, for example, 201, 202, 203, etc. In this way, a user of the evaluating apparatus 10, or a device (e.g., local or remote computing device 50, 52), may determine the time elapsed since the evaluating device 22 last passed a position marker 32, and the identity of that position marker. Because the time elapsed and position marker data relate to a characteristic of interest, such as a particular acceleration sensed by the evaluating device 22, the user may determine the location that the evaluating device was at when it sensed the characteristic.

In some embodiments, the timing unit 40 counts a time elapsing since the evaluating device 22 was first introduced to the system 12 and add indicia to the count whenever a position marker 32 is sensed indicating the identity of a particular marker. For example, the timing unit 40 may initially count or record as follows: 1, 2, 3, etc. For example, when a marker 32 is passed twenty seconds after first being introduced to the system, the timing unit 40 in some embodiments counts or records around that time as follows: 21', 22', 23', etc. If another marker 32 were passed one-hundred seconds after the previous marker, the timing unit 40 in some embodiments counts or records as follows around that time: 121", 122", 123", etc. In this embodiment, a user for device of the system may immediately determine identify of the most recent marker 32 passed by the evaluating device 22.

In some embodiments, the user or device determines the time elapsed since the evaluating device 22 passed the most recent marker 32 by determining the amount of time or counts having elapsed between the most recent change in count format (e.g., from primes to double primes). So if, for instance, the evaluating device 22 time switch from single to double primes between 120 and 121 seconds (i.e., 118', 119', 120', 121", 122", etc.) and an acceleration of interest was sensed at 130 seconds (i.e., 130"), it may be determined from this information that the acceleration occurred ten seconds after the second marker was passed.

In the fifth embodiment for processing time and marker data to determine time elapsed since the evaluating device 22 passed a marker and the identity of that marker (item (v), above), the apparatus 10 is configured so that the timing unit 40 keeps real, or clock time and provides this time to the local computing device 50 as a time stamp each time a position marker 32 is sensed and each time an event of interest is sensed. The apparatus 10 may also be configured so that the timing unit 40 provides time data to the local computing device 50 each time a position marker 32 is sensed and each time evaluation-sensor data is stored or transferred to the computing device 50. An example of real, or clock time is: 9:15:33 a.m. (and date).

By knowing the identity of the most recent marker 32 sensed (e.g., marker #2 or a second marker) when an event was sensed, a time stamp indicating when the most-recent marker was sensed, and a time stamp indicating when the event was sensed, the apparatus 10 is able to determine the amount of time having elapsed since the most recent marker was sensed and identity of that marker. In some embodiments, this elapsed time is calculated by determining a difference between the two time stamps. In one embodiment, the time stamps are stored, and the elapsed time is calculated in the local computing device 50. In one embodiment, the time stamps are stored in the local computing device 50 and the elapsed time is determined in the remote computing device 52.

In some embodiments, a location of the evaluating device 22 along the flow path 16 beyond the most recently sensed position marker 32 is determined by processing the time data and position-marker data (ten seconds beyond the second marker in the most recent example) along with an actual or average speed, from any source, such as one of those described, or speed that the evaluating device was or is expected to have been moving along the flow path 16 after the most recently sensed position marker. For example, the apparatus 10 (e.g., the local computing device 50) may be configured to determine that if the evaluating device 22 was or is expected to have been moving along a section of the flow path after a most recently sensed position marker 32 at a speed of about three feet per second, and if the evaluating device 22 senses an acceleration of interest in this section about five seconds after the evaluating device sensed the last position marker 32, the acceleration was sensed about fifteen feet beyond that last marker.

Once a particular location along the flow path 16 of the package-handling system 12 corresponding to an event of interest is determined, a particular location of the evaluating device 22 within a facility, such as a warehouse, or area enclosing or otherwise including the system may be determined. In various embodiments, this specific location within the system 12, or a facility or an area in which the system is located, may be determined by processing the time, position-marker, and speed data along with data about a layout (e.g., map, plot, etc.) of the flow path 16 of the package-handling system 12 within the facility or area. In some embodiments, the layout information of the flow path 16 within the system 12, facility, or area is stored in an electronic device such as the local and/or remote computing device 50, 52. In particular embodiments, the layout may also be stored on another medium, such as on paper.

As an example of determining a particular location of a system characteristic or condition of interest, such as an acceleration of interest, within a facility or area, consider the example provided above wherein the acceleration of interest occurred five seconds after a second position marker 32 was sensed. By processing the layout data, the location of the evaluating device 22 within the facility or area when the acceleration of interest was sensed may be easily determined. The layout (not shown in detail) may reveal that the evaluating device 22 was, for example, in a particular section of a warehouse and on a particular portion of a particular conveyor belt at the time.

Evaluating Device Details

FIG. 2 shows a closer perspective of an evaluating device 22 according to an embodiment of the present invention. As described above, the evaluating device 22 may be shaped and sized to, in many ways, resemble the size, shape, and weight of transport trays 20 commonly used in package-handling systems (e.g., standard transport trays), such as is the case when the evaluating device includes a transport tray (e.g., when a transport tray is the body 24 of the device). This resemblance may facilitate the evaluating device 22 being handled by the system 12 in a manner similar to the manner in which the non-evaluating, transporting, trays 20 are handled. In this way, the evaluating device 22 may, in various embodiments, move through the handling system with trays 20 carrying packages to evaluate the system 12 without disturbing or pausing normal operation of the system 12. In some embodiments of the present invention, the evaluating device 22 is configured so that the evaluating device 22 moving through the package-handling system 12 behaves similarly to non-evaluating devices 20 moving through the handling system 12, such as being carried by the system and responding to stimuli from the system in similar ways. In some embodiments, the evaluating device 22 is configured to resemble non-evaluating devices 20 in other ways as well, such as by comprising material similar in behavior and/or weight as material of non-evaluating devices.

Although the evaluating-device body 24 may have other shapes without departing from the scope of the present invention, in one embodiment, the body forms a six-sided generally rectangular box.

Although the accelerometer 28 may be connected to other locations of the evaluating device 22 without departing from the scope of the present invention, in one embodiment, the accelerometer 28 is positioned in the pocket or compartment adjacent the front or nose 58 end of the evaluating device.

Any one or more of the left 54, right 56, nose 58, and tail 60 of the evaluating device 22 may have flanges or walls 62 extending upward from a bottom 64 of the evaluating device 22, as shown in FIG. 2. Walls 62 on the left or right may be called wings. In some embodiments, the one or more walls 62 form a pocket 66 of the body 24. Each component of the evaluating device may be positioned in the pocket 66 of the body 24.

The evaluating device 22 may include any one or more of a variety of materials without departing from the scope of the present invention. As also shown in FIG. 2, the evaluating device 22 may include a local power source 68, such as a conventional battery, connected to other components of the evaluating device 22 by wire 70.

Unwanted static charge may build up in one or more parts of the evaluating device 22 as it is transported through the package-handling system 12. Although not identified in detail in the figures, the evaluating device 22 may include one or more static-repelling or static-discharging features. For example, the evaluating device 22 may include static straps connected to the evaluating device. Such static straps or similar-purpose element may contribute to discharging static away from parts of the evaluating device 22 (e.g., computing device 50) or from the evaluating device altogether. Static may be discharged to, for example, a conveying surface of the package-handling system 12, other part of the system, or facility or area in which the system is positioned.

In various embodiments of the present invention having a remote computing device 52, the evaluating device 22 and remote computing device are configured so that data generated on the evaluating device 22 may be transferred to the remote computing device to be processed or further processed. The evaluating apparatus 10 may be configured in any of a variety of ways to transfer data from the evaluating device 22 to the computing device 52. For example, as shown in FIG. 2, the evaluating device 22 may include a port 74 that may be connected by wire to the remote computing device 52. Although not shown in the figures, the apparatus 10 may include a remote docking station to which the evaluating device 22 is connected for extracting data from the evaluating device and/or for powering the evaluating device.

In one embodiment of the present invention, the evaluating device 22 includes a removable memory device, such as a memory card (not shown in detail). Data may be transferred from the evaluating device 22 to the remote computing device 52 by transferring and reading data on the memory card. The transferred data may include information associated with one or multiple distinct events of the package-handling system 12 sensed by the evaluating device 22.

The evaluating device 22 may also include a local transmitter or transponder 76 (identified in FIG. 2) operatively connected to the sensors 26, 30 and distance meter 40 of the evaluating device and/or the local computing device 50. In some embodiments, the transmitter is arranged to receive the sensor output signals and/or data from the local computing device 50 and wirelessly transmit the signals to a remote computing device 52. The evaluating apparatus may also include strategically placed re-transmitters, which may also be amplifiers. These re-transmitters may be configured, for example, to pass the signal from distant or difficult areas to a remote receiver or transponder 78 while perhaps boosting the signal.

The transmitter 54 may be connected to the sensors 26, 30 and distance meter 40 in a variety of ways such as by way of wires or by wireless connection using corresponding wireless devices (e.g., a Wi-Fi or Bluetooth® device) positioned within or connected to the transmitter 54 and the sensors 26, 30 and distance meter 40 (Bluetooth is a registered trademark of Bluetooth Sig, Inc., Corporation, of Bellevue, Wash.). The transmitter 54 may be configured to transmit data by radio signals.

Compact Configuration

In various embodiments of the present invention (not shown in detail), the parts of the evaluating device 22 are connected together in a relatively compact manner. In some of these embodiments, the compact evaluating device is arranged so that the device can be attached adjacent (e.g., to) a transport bin or tray 20 without being disposed in a bed of the tray. For example, in one particular embodiment, the evaluating device is configured in a compact form to be connected in its entirety adjacent a front end of a transport tray 20. For transport trays including a front end portion having a hollow or other opening, such as a fairing common on many transport bins, the compact evaluating device may be configured to be positioned within the hollow or opening.

As mentioned above, the evaluating device 22 or parts of it may be configured for removable connection to the transport tray 20 for selective installation and removal. Regarding compact configurations of the device, the entire compact arrangement, or parts thereof, may be configured to be releasably attached adjacent the tray 20. In some embodiments, the compact configuration of the evaluating device includes one or more releasable fasteners, such as clips, screws, or clamps, for removably attaching the device or parts thereof to the tray.

For embodiments in which the evaluating device 22 is connected to a tray 20 for operation of the device, the device, including the distance meter 40 and position-marker sensor(s) 30, should be configured and connected to the tray so that the device can accurately sense the position markers 32 and vibrations encountered by the tray. For particular embodiments in which the distance meter 40 includes an air gauge meter such as an anemometer 42, the evaluating device 22 should be configured and connected to the tray 20 and so that air is able to pass freely through the air gauge meter while the tray is moving along the path 16. For sensing vibrations, the evaluating device 22, or at least relevant parts, such as an evaluation sensor 26 being an accelerometer, should be attached to the tray with a degree of firmness allowing the evaluating device to accurately sense vibrations exerted on the tray.

For ensuring that air can move freely through an anemometer 42 or other air gauge, the device 22 should be configured and connected to the tray 20 so that the tray or other structures do not block the air tunnel or chamber 39. In some embodiments, it is preferred that the evaluating device 22, or at least any air gauge part, be attached adjacent (e.g., to) a front of the tray 20. In some embodiments, the air gauge is configured and connected to the tray 20 so that a tunnel or chamber 39 of the air gauge through which air passes is positioned above corresponding wall or walls 62.

In some embodiments (not shown in detail), the evaluating device 22 and the tray 20 are configured and connected together so that the air gauge or at last a part of the gauge is disposed within a wall 62 of the tray, such as a front wall. For example, in one embodiment of the present invention, an opening is formed in a front wall 62 of a tray, such as a front fairing common on some package-transport bins, and the evaluating device 22 is configured and connected to the tray so that an air passage of an air gauge (e.g., an air tunnel or chamber 39 of an anemometer 42) is positioned adjacent the opening so air is able to pass freely through the opening of the tray and through the air tunnel or chamber of the gauge.

Embodiments in which an air gauge is connected adjacent an opening in a wall 62 of a tray 20 is not limited to embodiments in which the evaluating device is compact. For example, an air gauge such as the anemometer 42 shown in FIGS. 1 and 2 could be configured and connected adjacent an opening in a wall 62 of a tray 20.

The compact embodiments of the evaluating device may have various shapes and sizes without departing from the scope of the present invention. In some embodiments (not shown in detail), the evaluating device includes a frame or housing connecting at least some of the parts of the evaluation device and/or holding at least some of the parts of the device. In some embodiments, the device, such as a housing, frame, and/or parts of the device, forms a generally box shape.

The housing or frame may have a door or other movable (e.g., hinged) or removable portion, such as a cover. Such door or cover may be used for various purposes including for accessing an interior of the evaluating device for configuring or maintaining the device. For embodiments of the evaluating device having a housing or frame, the housing or frame may include openings through which data or power may be passed. For example, a port such as the port 74 described above may be positioned adjacent an opening in the housing for connecting a wire to the device. Other features for positioning adjacent openings in a housing or frame, including switches for turning the evaluation device or parts of the device on or off, or for adjusting or tuning parts of the device, such as the potentiometer described above.

For compact embodiments of the evaluating device having an air gauge such as an anemometer 42, the gauge is positioned amongst other parts of the evaluation device so that air is able to freely flow between an entry and exit of the air tunnel or chamber of the gauge. For example, in some embodiments, the evaluating device includes a front side and a back side having corresponding openings and the air gauge is positioned between them so that air is able to move freely into the evaluating device through the front side opening, through the tunnel or chamber of the air gauge, and out of the device through the back side opening.

In one embodiment, the compact evaluating device is shaped generally as a box having a thickness of between about 3 cm and about 5 cm, a width of between about 12 and about 19 cm, and a length of between about 30 cm and about 42 cm. In a particular embodiment, the compact evaluating device has a thickness of about 3.8 cm, a width of about 17.8 cm, and a length of about 40.6 cm.

Remote Devices

In various embodiments, the remote computing device 52 is positioned remote to the evaluating device 22 while the evaluating device 22 is being handled by the package-handling system 12. For example, the remote computing device 52 may be positioned at a central location within a warehouse in which the package-handling system operates or even more remotely (e.g., in a maintenance area of the warehouse), such as remote to such a warehouse. It is contemplated that the evaluating apparatus 10 may also be connected to a network, such as the Internet, for users of the apparatus to monitor or evaluate conditions associated with the package handling system at various times and from various locations.

As shown in FIG. 1, the remote computing device 52 of the evaluating apparatus 10 may include or be connected to a remote receiver 78. The receiver 78 is arranged for receiving wireless signals from the local transmitter 76 of the evaluating device 22 and transmitting the signals to the remote computing device 52. In embodiments in which the remote receiver 78 is a transponder, it may be configured to receive signals from the remote computing device 52 and transmit them to the evaluating device 22.

As described below in further detail, the remote computing device 52 may be configured to process the signals received from the sensors 26, 30, the distance meter 40, and/or the local computing device 50, such as by way of memory card or wireless transmission. As with the local computing device 50, the remote computing device 52 may be configured to process the signals from the evaluating device 22 by, for example, analyzing the signals to determine in real time whether an unwanted condition of the package-handling system 12 exists or may exist at any particular time as the evaluating device 22 is moving through the system. Knowing where the evaluating device 22 is in real time as it senses a problem or potential problem before it occurs may be useful for many reasons, such as for accurately and quickly dispatching maintenance personnel.

As described regarding the local computing device 50, the remote computing device 52 may be configured to identify certain characteristics about an unwanted condition, such as a likely cause of the condition, by analyzing data including accelerometer data. Examples of unwanted conditions include guide-wheel misalignments, conveyor belt misalignments, and drive mechanism problems. Drive mechanisms (not shown in detail) of many package-handling systems include drive parts such as pulleys or belts. When one of the drive parts is offset, undesired bumps may result, often in the form of generally vertical bumps. If a conveyor belt of a package-handling system was offset to the left or the right, this misalignment may produce a particular type of vibration. Acceleration outside of normal accelerations may also include those along the forward-rearward direction, such as may result from the evaluating device 22 bumping into or being bumped by a transport tray 20 or the package-handling system 10 in an unwanted manner.

The evaluating apparatus 10 may also include remote devices 80 other than the remote computing device 52 and receiver 78. Other remote devices 80 may include communication elements 82 operatively connected to the remote computing device 52 for notifying users of the evaluating apparatus 10 of conditions of the package-handling system 12. Further, it is contemplated that in some embodiments of the present invention the communication elements 82 may be configured to allow users of the apparatus 10 to input desired information, such as for programming or instructing the remote computing device 52 or the evaluating device 22. It is also contemplated that, in some embodiments of the present invention, the communication elements 82 may be configured to allow users of the apparatus 10 to selectively review information, such as for examining present or real-time data and historical data produced by either computing device 50, 52 using output signals of the sensors 26, 30. The remote devices 80 and their functions are described further below.

Other Locating Systems

Although embodiments for locating the evaluating device 22 described above include identifying position markers adjacent the flow path 16 of the package-handling system 10, the evaluating apparatus 10 may determine location of the evaluating device in other ways in other embodiments. In one contemplated arrangement (not shown in detail), the evaluating apparatus 10 uses a global navigation satellite system (GNSS), such as the global position system (GPS). In this embodiment, the evaluating device 22 includes a GPS receiver. In some embodiments, position and movement information for the evaluating device 22 is determined in the GPS receiver and/or local computing device 50 onboard the evaluating device using signals received by the receiver from the GPS satellites. In some embodiments, the position and movement information is calculated remotely from the evaluating device 22, such as in the remote computing device 52. The position information may include longitude, latitude, and perhaps elevation coordinates. Movement information may include speed or velocity.

In one contemplated embodiment, the evaluating apparatus 10 includes a local positioning system (LPS) (not shown in detail). In some embodiments of the present invention, the LPS includes an LPS tag positioned on the evaluating device 22 that is readable by multiple antennae or other sensor (not shown) positioned around the package-handling system 12. In some embodiments, the tag is a radio-frequency identification tag (RFID tag) read by relatively low-power radio signals. The RFID tag may be a passive or an active RFID tag, as well known in the art. The remote computing device 52 may be adapted to determine the evaluating device's location in real time by processing data output from the antennae. The LPS may also include one or more boosters or amplifiers to ensure signals are carried between the evaluating device and LPS antennae or sensors.

It is also contemplated that, in certain embodiments, the evaluating device 22 includes a radio transponder. In such embodiments, the apparatus 10 may include multiple stationary stations positioned at known locations around the package-handling system configured to be sensed by the evaluating device, such as via radio signals. These location-determining components may include a short-range version of the well-known long range aid to navigation (LORAN). The location-determining components of this embodiment may also include amplifiers to ensure signal transfer between the evaluating device 22 and remote stations. In such embodiments, the position of the evaluating device 22 may be determined by, for example, evaluating distances between the evaluating device 22 and the stationary signal stations using a common method such as triangulation. Evaluation may take place, for example, in the evaluating device 22, in the local computing device 50, or in the remote computing device 52 in a variety of ways. For example, in some embodiments, location of the evaluating device 22 is determined at regular intervals (e.g., every 30 seconds) or upon occurrence of a particular happening, such as the user requesting one of the computing devices 50, 52 to seek the location. Evaluating device location may also be determined automatically upon determination that the accelerometer 28 has sensed a system characteristic of interest (e.g., an acceleration of interest) representing a problem or potential problem.

In one embodiment of the present invention, the evaluating apparatus may include a type of inertial navigation or guidance system (INS or IGS). An INS may track movement of the evaluating device 22 in all directions. By knowing an initial position and initial orientation of the evaluating device 22, the remote computing device 52 or local computing device 50 is able to process movement information about the evaluating device to determine the evaluating device's position and orientation at any subsequent time.

In various embodiments, the INS may include various devices for measuring movement of the evaluating device 22, such as one or more accelerometers and/or gyroscopes. For example, the INS may use the same accelerometer 28 used by the evaluating device 22 for detecting accelerations of interests of the package-handling system 12. Even in embodiments not using an INS, it is contemplated that the evaluating device 22 may include a gyroscope or other orientation-sensing device for providing or updating information about the evaluating device's orientation.

In particular embodiments, the accuracy of INS's may generally decrease in proportion to an amount of movement since the starting position and orientation were determined. This decrease in accuracy may be due to accumulation of measuring inaccuracies and system losses. It is contemplated that the system may include one or more points intermediate a start and end of the flow path 16 of the system 12, at known locations. The INS may be configured to reset or update the evaluating device's origin position and orientation to each midway point as the apparatus 10 senses that the package has reached the respective point. Resetting the origin would effectively remove errors accumulated since the previous origin, thereby increasing accuracy of position and orientation determinations.

The evaluating apparatus 10 may include other location-determining systems without departing from the scope of the present invention. For example, the apparatus 10 may use existing sensors of the package-handling system 12, such as radar sensors or cameras (not shown). These system 12 sensors may be configured to identify when the evaluating device has passed particular points in the system 12.

Additional Analysis Techniques

It is contemplated that the evaluating apparatus 10 may, in various embodiments, be configured to identify a condition of the package-handling system 12 by considering, at least in part, an orientation and/or a location of the package at the time the characteristic was sensed. These features may be helpful in analyzing the system 12. For example, if the apparatus 10 determined that a particular acceleration experienced by the evaluating device 22 stems from a left side of a conveyor belt of the system 12 at a particular location, the apparatus may also be configured to determine that the acceleration is likely due to a certain guide wheel beneath a right side of the conveyor belt. Along with the cost and time savings from knowing the location of a problem, savings may result from knowing additional characteristics of the problem, such as from informing personnel of needed tools and parts before they walk to the area in which the problem was sensed.

Additional Data Analysis

In some contemplated embodiments of the present invention, the local computing device 50 is configured to store data received from one or more evaluation sensors 26, such as the accelerometer 28, instead of sending the data in real time to the remote devices 80, or along with such real-time transmission. In these embodiments, data relating to conditions of the package-delivery system 12 sensed by the sensors 26 may be retrieved from the local computing device 50 at select times, such as after the evaluating device 22 has completed an entire trip through the system.

The local computing device 50 may also provide data to other parts of the evaluating device 22, such as by sending instructions to the accelerometer 28 or other components of the evaluating device for controlling their operation. The local computing device 50 may also perform an initial processing of output signals of the accelerometer 28 or other sensors 26 (e.g., gyroscope), and provide the result to the transmitter 76 for being sent to the remote computing device 52 for further processing.

The local computing device 50 may send various types of data to the remote computing device 52 and package-handling system 12 in addition to data corresponding to output signals of the sensors 26, 30 (e.g., accelerometer 28) and the distance meter 40. Through communications with the package-handling system 12, the remote and local computing devices 50, 52 may determine helpful data, such as a speed at which a conveyor belt of the system is moving, despite the evaluating device 22 indicating that the evaluating device is not moving in that section based on that sensed by the evaluating device (e.g., where there is a package jam in the system 12 keeping the evaluating device from moving).

Moreover, the remote and local computing devices 52, 50 and the package-handling system 12 may be connected together and configured such that the evaluating apparatus 10 controls all or part of the package-handling system. For example, when the evaluating device 22 senses a problem or a potential problem, the apparatus 10 may initiate a change of system 12 operation, such as by temporarily turning off the system or a section thereof. The computing devices 50, 52 may also store the acceleration data and/or communicate the acceleration data to users of the evaluating apparatus 10 by way of the communications elements 52.

In some contemplated embodiments of the present invention, the evaluating apparatus 10 includes more than one evaluating device 22, which may be introduced into the package-handling system 12 at the same time at about the same location or at different locations. The evaluating devices 22 may also be introduced into the system at different times. In these embodiments, the remote computing device 52 may be configured to process real-time data and/or historic data received from the multiple evaluating devices 22 in evaluating operation of the package-handling system 12.

The remote computing device 52, like the local computing device 50, may also be configured to determine characteristics associated with the evaluating device 22 based on data received from the accelerometer 28. For example, the remote computing device 52 may use pattern recognition and/or neural network software to determine a speed, orientation, or location of the evaluating device 22 based on accelerations of the evaluating device as it is being handled by the package-handling system 12. In some embodiments, the computing devices 50, 52 use such programming to analyze sensor 26 data, such as acceleration data from the accelerometer 28, in evaluating conditions associated with the package-handling system 12 and identifying particular events therein.

Pattern recognition software may be programmed to analyze a variety of features within evaluation data (e.g., acceleration data), such as frequency and amplitude of sensed data. The remote computing device 52 may be configured to determine whether a problem is possible, probable, or imminent based on the evaluation sensor 26 data. For example, when the evaluating device 22 senses vibrations outside of normal characteristics for the location of the system 12 where they were sensed, but not amounting to a conclusion that there is clearly a problem, the computing device may be configured to recognize that a problem may likely be developing in the system.

In various embodiments, the evaluating apparatus 10 includes a calibrating or learning function by which the computing device 50, 52 is taught to correlate particular inputs with particular anticipated situations. The apparatus 10 may be introduced to the handling system 12, and the computing device 50, 52 programmed to recognize an event, such as a particular missing or worn guide wheel, as being associated with particular evaluation sensor 26 or distance meter 40 signals, such as particular acceleration sensor output signals (e.g., a certain pattern) or particular acceleration signals at a certain time or location of the evaluating device 22 (e.g., an acceleration signal in a usually very smooth portion of the flow path 16).

It is contemplated that the apparatus 10 may learn by sensing, processing, and being programmed before and/or during use of the apparatus. The computing devices 50, 52 may also be configured to combine various pieces of real-time data and/or historic data received from the sensors 26, 30 and distance meter 40 to determine a present condition of the package-handling system 12 or to determine that though sensor data does not indicate that the system clearly has a present problem, a problem may likely be developing in the system.

It is also contemplated that the computing devices 50, 52 may be programmed during such a learning phase while the evaluating device 22 is being moved through the package-handling system 12 to recognize that various sensed system characteristics, such as particular accelerations, correspond to various locations within the system.

Evaluating device-location data created by the computing device 50, 52 using sensor 26, 30 and/or distance data may be further processed by the computing devices 50, 52 instead of or in addition to location data from other location-determining arrangements.

Communications

As shown in FIG. 1, the communication elements 82 may include a visual display 84 for displaying information received from the computing devices 50, 52. The remote computing device 52 may be configured (e.g., programmed) to provide information to the visual display 84 for display to a user in any of a variety of formats, such as spreadsheets, charts, and graphs. A spreadsheet, for example, may show accelerations in each direction along which the accelerometer sensed (e.g., x, y, and z). In some embodiments, this data is displayed in connection with the relevant section or track identification number (e.g., track no. 413), which may be determined by the position-marker data showing the most recent marker 32 sensed at the time that the corresponding system conditions (e.g., accelerations) where sensed. For example, in a display, such as a chart, acceleration data indicating a particular acceleration above a threshold value may be displayed in the chart in the same column or row with data about the location at which the evaluating device 22 was at when the particular acceleration was sensed by the evaluating device. Using such display, a user of the apparatus 10 is able to identify where in the system 12 a particular event occurred and characteristics of that event, such as an amount of acceleration measured.

In various embodiments, the data is displayed in connection with data about location of the section or track, such as a number of feet from a start of the section or track, corresponding to sensed system data. The data may also include time data and perhaps speed data so that the computing device 50, 52 or user of the apparatus 10 is able to easily determine the location on the track by considering the time data and received or already stored speed data (e.g., from distance data of the anemometer 42). For some of the embodiments of the present invention in which the apparatus includes layout data about the flow path 16 and/or facility or area in which the flow path is located (e.g., a warehouse layout), the displayed data shows a location within the facility or area corresponding to the sensed system conditions. For example, the display may show that a particular acceleration occurred on a particular belt, in a particular part of a particular zone of a package-handling hub facility.

In some embodiments, information displayed by the visual display 84 advises users of conditions associated with the package-handling system 12 (e.g., "Section three of conveyor belt four is badly damaged"). The information may also include instructions advising the users how to proceed (e.g., "Monitor closely" and "Please repair belt"). The evaluating apparatus 10 (e.g., the remote computing device 52) may also be configured to send such messages to users through other contemporary channels, such as by email, voicemail, or text message using the Short Message Service (SMS).

The communication elements 82 of the evaluating apparatus 10 may also include an acoustic source 86, such as a speaker, buzzer, horn, or siren. In some embodiments, by way of the acoustic source 86, the computing device 52 audibly communicates messages to users of the evaluating apparatus 10 and the package-handling system 12. These messages may be verbal, advising users of conditions associated with the package-handling system 12 (e.g., "Belt two is misaligned"

or "Drive mechanism operating improperly in section four"). Such verbal message may also include instructions advising the users how to proceed (e.g., "Please repair belt two").

The communication elements 28 may include other types of visual sources such as a light source 88. An exemplary light source is a light-emitting diode (LED). As with the visual display 84 and the acoustic source 86, the light source 88 may receive signals from the computing device 52 and operate accordingly to communicate information to users of the evaluating apparatus 10 and the package-handling system 12. For example, the light source 88 may include a green LED, a yellow LED, and a red LED, which may be selectively illuminated in response to corresponding signals from the computing device 52 to respectively indicate to users, for example, good package-handling system conditions, slightly or potentially problematic conditions, problematic conditions, or instructions for proceeding.

The evaluating apparatus 10, and the remote computing device 52 and light source 88 in particular, may also be configured to communicate various messages to users in other ways, such as by being illuminated/not illuminated or by blinking in various ways. Also, the light source 88 may include a light behind a message, such as "Please attend to misalignment on conveyor #2", which may be illuminated by a light of the light source 88 at instruction of the computing device 52.

The apparatus 10 may include multiple elements of the various types of communication elements 82 (e.g., more than one visual display 84, more than one acoustic source 86, etc.). The communication elements 82 may be positioned at various locations, such as within the package-handling system 12, in a remote central monitoring or maintenance office near the handling system, and/or in an even further remote monitoring location, such as off site from the handling system.

Communication elements 82 positioned in particular locations may display information particular to the location. For example, a visual display 84 positioned within or adjacent a specific part of the package-handling system 12 may display information relevant only to users within or adjacent that part of the system (e.g., "Please attend to misaligned conveyor belt in this area") and an acoustic source 86 positioned within or adjacent a specific part of the system may provide instructions and/or tones audible in that area for communicating to users in or adjacent that area.

Data Input

As also shown in FIG. 1, the communication elements 82 may also include various input elements, such as a keyboard 90 and a mouse 92. As described above, the computing device 52 and communication elements 82 (e.g., the keyboard 90 and the mouse 92) may be configured to allow users of the apparatus 10 to provide desired information into the evaluating apparatus 10. For example, users may input information to the computing device 52 by way of the keyboard 90 for programming the computing device or providing instructions or information to the evaluating device 22 by way of the computing device. For example, the user may communicate with the computing device 52 to program the computing device to provide the user with only certain information, such as to display only information from one of multiple sensors (e.g., the accelerometer 28, distance meter 40, or one of multiple accelerometers) of the evaluating device 22.

The user may also associate in the computing device 50, 52 a particular measurement or measurements of the apparatus 10 with a determined cause of that measured. The user may also associate other information with the particular measurement or measurements, such as an advised action for personnel. For example, after determining that a particular acceleration at a particular location with the system 12 was due to a certain cause, such as a worn guide wheel needing replacement, the user may store in the computing device 50, 52, in connection with the particular acceleration and location, data identifying that the acceleration at the location resulted from a worn guide wheel and that a new wheel solved the problem.

In some embodiments, a user creates and stores information having acceleration, location, and condition data based at least in part on their experience with the system 12. For example, a user, knowing that a conveyor belt of the system 12 in a certain location is likely to become misaligned may create a record in the computing device 50, 52 associating a certain acceleration value or characteristic (e.g., many successive accelerations) with the expected problem (the misaligned belt in this example).

As an example application of this cause-and-result data, the computing device 50, 52, or user evaluating output data from the computing device, may in later evaluations of the system 12 using the apparatus 10 recognize that the same or a similar acceleration in the same or similar location of the system 12 is or may be due to a certain cause, such as a worn guide wheel. In some embodiments, the apparatus 10 indicates the likelihood that a problem is due to a particular cause based on a similarity between (a) the sensed acceleration and determined corresponding location and (b) stored cause-and-result data. For example, if a type (e.g., magnitude, distribution) of a measured acceleration is the same as a past acceleration measured in the same location, the apparatus 10 may be programmed to predict that the measured acceleration has, or very likely has, the same cause as that previously determined for the past acceleration of the same type and location. As another example, the apparatus 10 may be programmed to predict that, if an acceleration type (e.g., magnitude, distribution) is similar to, but not the same as, a past acceleration measured in the same or nearby location, the acceleration measured might have, or possibly has, the same cause as that previously determined for the past acceleration of the same type and location.

In some contemplated embodiments, the evaluating apparatus 10 (e.g., computing device 50, 52) is programmed with information about the nature and/or status of components of the system 12, and considers this information in other functions such as in reporting sensed accelerations to the user and predicting a cause of sensed accelerations. For example, if a specific guide wheel was recently replaced, the user may input data indicating the same. The apparatus 10 may be programmed, for example, so that if accelerations near the relatively new guide wheel are sensed, the apparatus notifies the user of the new wheel with notification of the accelerations. A user may deduce from this information that, for example, the accelerations are not likely due to that wheel being worn and may be due to a problem with another part or with that wheel being faulty or improperly installed. As another example, the apparatus 10 may be programmed so that if accelerations near the relatively new guide wheel are sensed, the apparatus will be less likely to predict that that wheel being worn is the likely cause, even if the acceleration is in the same place and of a similar type as an acceleration previously measured in that place when a prior wheel there was worn.

In some embodiments in which the apparatus 10 filters evaluation-sensor output, the apparatus (e.g., computing device 50, 52) is configured to identify accelerations having certain characteristics such as a particular distribution. The apparatus 10 may be configured to allow a group of accelerations having one or more particular characteristics through its filter even though one, more, or all of the accelerations in the group are below a threshold value or range. An example of a particular characteristic is relatively rapid or successive accelerations. As another example, the computing device 50, 52 may be programmed to recognize that certain accelerations indicate a specific condition of interest, such as a specific problem or a potential problem, considering their location within the item-transport system 12. This programming may be done using data input by a user of the apparatus 10 based at least in part on their experience with the system 12, such as with system operation and from trials using the apparatus. As an example, the computing device 50, 52 may be programmed to recognize that three relatively-rapid accelerations along the y axis of about 1 g at a position being a certain distance before a particular conveyor belt transition point (e.g., from one belt to another in the system 12) indicates a problem or potential problem with the system 12 in that area. The problem may be, for example, a misaligned belt or worn guide wheel.

A user may also enable or temporarily disable parts of the evaluating apparatus 10, such as by selectively turning sensors, such as the accelerometer 28, in the evaluating device 22 on or off. For communications to and from the evaluating device 22, the remote computing device 52 may interact directly with parts of the evaluating device (e.g., the accelerometer 28) or with the local computing device 50, which in turn communicates with the other parts of the evaluating device.

General System Operation

The package-handling system 12 may include machinery, devices, vehicles, and people and is not limited to a conveyor system. For example, in some embodiments, the package-handling system 12 may include a subsystem in which the evaluating device 22 is picked from an inventory shelf, a conveying subsystem, such as that shown in part in FIG. 1, and post-conveying subsystems, such as machines moving the evaluating device to a transfer vehicle, which may also be part of the package-handling system.

As described above, in some embodiments of the present invention, more than one evaluating device 22 may be placed in the package-handling system 12 at the same time. These multiple evaluating devices 22 may be introduced into the system in various ways, such as by being introduced to the system at the same place at about same time (e.g., sequentially), at different places at about the same time, at the same place at different times, or at different places at different times. As mentioned above, the evaluating device 22 may be handled by the package-handling system 12 and monitor the system at the same time that the system is handling non-evaluating, transport trays 20.

While the evaluating device 22 is being handled by the package-handling system 12, the one or more sensors 26, 30 and/or the distance meter 40 of the evaluating device, such as the accelerometer 28, may sense conditions associated with the package-handling system. For example, when one of the sensors is an accelerometer 28, the accelerometer senses vibrations of the package-handling system 12 imposed on the evaluating device 22.

After or while the evaluation sensors 26 are sensing conditions associated with the package-handling system 12, output signals from the sensors may be transferred to a storing device such as the local computing device 50 or the remote computing device 52. In some embodiments, the sensor 26 data is sent to the transmitter 76, which would transmit the data to the remote receiver 78 for transfer to the remote computing device 52. Alternatively, the data may be transferred to the remote computing device 52 by connecting the port 74 of the evaluating device 22 to the remote computing device by wire. In some embodiments, the data is transmitted from the evaluating device 22 to the remote computing device 52 wirelessly, such as by a Wi-Fi or Bluetooth® connection. As mentioned above, in one embodiment of the present invention, the evaluating device 22 includes a removable memory device, such as a memory card (not shown in detail). As provided above, in some embodiments the local computing device 50 is removably attached adjacent a transport tray 20 or adjacent a balance of the evaluating device 22, which will allow selective attachment and removal of the local computing device for purposes such as programming, maintenance, and data transfer from the local computing device in analyzing the system 12.

Data may be transferred from the evaluating device 22 to the remote computing device 52 by transferring and reading data on the memory card. The transferred data may include information associated with one or multiple distinct events of the package-handling system 12 sensed by the evaluating device 22.

In some embodiments, the remote computing device 52 analyzes the signal data received from the evaluating device 22 to determine whether the signal data indicates an interesting event or condition (e.g., an undesired condition) associated with the package-handling system 12, such as a misaligned conveyor belt. In some embodiments, the conditions sensed by the evaluation sensors 26 and identified by the computing devices 50, 52 also includes characteristics of the evaluating device 22, such as the speed, orientation, or location of the evaluating device. And in some embodiments, the computing device 52 recognizes when such characteristics are outside of certain specifications, such as when the package is moving faster than a pre-determined speed.

As mentioned above, operation of the evaluating apparatus 10 may include a learning or calibrating phase in which the evaluating device 22 is subjected to stimuli, such as by being moved through the package-handling system 12, and the computing device 50, 52 may be programmed to associate particular stimuli with particular conditions or events. For example, in some embodiments of the present invention, the computing device 50, 52 is programmed to recognize a misaligned conveyor belt by being taught how the conveyor belt moves (e.g., vibrates) when aligned and to determine that a misalignment exists or may exist when the belt moves in other ways. Also, the computing device 50, 52 may be programmed to recognize a misaligned conveyor belt by being taught how the conveyor belt moves (e.g., vibrates) when misaligned in one or more ways and to determine that a misalignment exists or may exist when the belt moves in that way.

As a particular example of the embodiments in which the apparatus 10 is configured to recognize particular faults in the system, the computing device(s) 50, 52 may be programmed to realize that when the evaluating device 22 vibrates abnormally when it is about twenty feet beyond a third position marker 32 and when it is about thirty-five feet beyond that third marker, the system 12 likely has alignment problems caused by conveyor belt joints (not shown in detail) present twenty and thirty-five feet beyond the third position marker. By identifying such problems early, further system damage may be avoided, such as damage that may otherwise result from improper loading of guide wheels near these two joints due to the joints being misaligned. In one embodiment, the computing device 50, 52 is programmed to recognize that such accelerations likely result from such joint problems by being programmed to recognize that these locations (twenty and thirty-five feet beyond the third marker) are adjacent joints and such vibrations (e.g., having a certain pattern and/or magnitude) adjacent joints would likely be due to joint misalignment or are likely due to joint misalignment. In one embodiment, the computing device 50, 52 recognizes that joint misalignments are present or likely at the particular locations of this example (twenty and thirty-five feet beyond the third marker) by accessing data from previous, actual or test runs, wherein accelerations caused by joint misalignments in the same locations were sensed. The accessed data may be stored in memory of the computing device 50, 52 and include acceleration data and location data.

When the computing device 50, 52 senses the acceleration in the particular locations in this particular example (twenty and thirty-five feet beyond the third marker), the computing device would automatically search its memory for records having data about similar accelerations sensed in these locations in previous system evaluations, actual or test. As previously described above regarding some embodiments, if such previously sensed accelerations were known or determined to be associated with a particular cause or condition, a user of the apparatus 10 would add the cause or condition to the record. In this way, when the computing device 50, 52 identifies the record, the computing device is able to communicate the associated cause to the user, such as by way of one of the communication elements 82, as described in more detail above.

In some embodiments, the computing devices 50, 52 are programmed to recognize a location of the evaluating device 22 during the learning phase by being programmed to associate particular movements of the evaluating device 22 sensed by evaluation sensors 26, such as the accelerometer 28, with particular parts of the package-handling system 12. Users or designers of the evaluating apparatus 10 may program the computing devices 50, 52 using the communication devices 82, such as the visual display 84 (e.g., computer monitor), the keyboard 90, and the mouse 92.

The computing device 52 may also be configured to determine location of the evaluating device 22 by one of the other location-determining arrangements described above, such as the arrangement including position markers 32 located adjacent the package-handling system 12 and the position-marker sensor 30 positioned in the evaluating device 22.

Having information about location of the evaluating device 22 would be helpful in many ways. For example, the computing device 50, 52, determining that a problem or potential problem associated with the package-handling system 12 exists, may also recognize a location of the problem or potential problem. Knowing location of a problem or potential problem may assist in monitoring the package-handling system 10 by, for example, allowing users of the package-handling system 12 to quickly attend to the problem or potential problem. Users would also be able to clear an area of personnel as needed as a safety precaution. The user or computing device 50, 52 may also selectively control the package-handling system 12, such as by shutting down a section of the system.

The evaluating apparatus 10 may also be configured to provide a notification or an alert at a central location, such as a maintenance or control room in which the remote computing device 52 sits, or in an area of the problem or potential problem sensed by the evaluating device 22, using the communication elements 82.

As described above, the computing device 50, 52 may provide information to the communication elements 82 (e.g., the visual display 84, the acoustic source 86, the light source 88) for notifying users of conditions associated with the package-handling system 12 in a variety of formats. For example, the computing device 50, 52 may present lists, spreadsheets, charts, or graphs to the user by way of the visual display 84. The computing device 50, 52 may be configurable by users to provide these and other types of information to the users based on signals received from the evaluating device 22. The computing device 50, 52 may also communicate messages to users in the form of verbal messages or sounds (e.g., tones) by way of the acoustic source or in the form of particular lights (e.g., lights having various colors), patterns of lighting (e.g., blinking), or illuminated signage including the light source 88. As described above, the evaluating apparatus 10 (e.g., the remote computing device 52) may also be configured to send such messages to users through other contemporary channels, such as by email, voicemail, or text message using the Short Message Service (SMS).

Information communicated to the users via the communication devices 82 may inform them of conditions associated with the package-handling system 12, such as a speed at which a conveyor is moving, a belt misalignment or a likely or apparent belt misalignment. In some embodiments, the information communicated to the users includes instructions advising the users how to respond, such as when the computing device 52 causes the acoustic source 86 or monitors of the visual display 84 to broadcast or display a message for all users to hear or see or for users in a particular area of the package-handling system (e.g., "Please attend to a misaligned belt in this area").

In these and other ways, evaluating apparatuses 10 according to the present invention may be used to identify particular conditions associated with the package-handling system 12 and advise users of those conditions, reliably and accurately at relatively low cost. Example conditions include misaligned conveyor belts, guide wheels, or drive mechanisms. By sensing particular conditions associated with the package-handling system 12, the evaluating apparatus 10 may identify problems and potential problems of the system.

Early detection of problems and potential problems may be especially helpful in various embodiments of the present invention for maintenance and operation of the package-handling system 12 because it allows present problems to be addressed early, may limit negative effects (e.g., personal injury or damage to packages 14 or to the system), and/or allow targeted preventative maintenance. Identification of the location of a problem or potential problem may be helpful in other ways, in various embodiments of the present invention, including saving time and cost by informing personnel of the area or exact location of the problem and perhaps informing them of needed tools and parts.

When introducing elements of the present invention or the preferred embodiment(s) thereof, the articles "a", "an", "the", and "said" are intended to mean that there are one or more of the elements. The terms "comprising", "including", and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended listing of inventive concepts. Although specific terms are employed herein, they are used in a generic and descriptive sense only and not for purposes of limitation.

What is claimed is:

1. An evaluating apparatus arranged to evaluate an item-transport system having a flow path along which items are transported, the apparatus comprising:

one or more position markers positioned adjacent the flow path of the item-transport system;

an evaluating device configured to sense the position markers and conditions of the item-transport system while the evaluating device is being transported along the flow path through the item-transport system, the evaluating device including:

an evaluating-device body;

at least one evaluation sensor connected adjacent the evaluating-device body and configured to: (A) sense conditions of the item-transport system while the evaluating device is being transported through the item-transport system and (B) produce evaluation-sensor data based on the sensed conditions;

a position-marker sensor connected adjacent the evaluating-device body and configured to sense said position markers and produce position-marker data; and a distance meter connected adjacent the evaluating-device body and configured to produce distance data; and at least one computing device configured to receive said data from the evaluation sensor, the position-marker sensor, and the distance meter and determine a particular location at which the evaluating device was along the flow path of the item-transport system when a particular condition of said conditions of the item-transport system was sensed, wherein the computing device is configured to determine said particular location based at least in part on the evaluation-sensor data, the distance data, and the position-marker data.

2. An evaluating apparatus as set forth in claim 1 wherein the distance meter includes an anemometer.

3. An evaluating apparatus as set forth in claim 1 wherein the computing device is a part of the evaluating device and connected adjacent the evaluating-device body.

4. An evaluating apparatus as set forth in claim 1 wherein the evaluation sensor is connected to the evaluating-device body.

5. An evaluating apparatus as set forth in claim 1 wherein the distance meter is connected to the evaluating-device body.

6. An evaluating apparatus as set forth in claim 1 wherein the particular location includes a distance on the flow path beyond a particular position marker of said markers.

7. An evaluating apparatus as set forth in claim 1 wherein:

the evaluation sensor includes an accelerometer configured to sense accelerations experienced by the evaluating device while the evaluating device is being transported through the item-transport system and said evaluation-sensor data includes corresponding acceleration data; and the computing device is configured to receive said data from the accelerometer, the position-marker sensor, and the distance meter and determine the particular location of the evaluating device along the flow path of the package-handling system where a particular acceleration of said accelerations was sensed, wherein the computing device is configured to determine said particular location by processing the acceleration data, the distance data, and the position-marker data.

8. An evaluating apparatus as set forth in claim 7 wherein the computing device, in being configured to determine the particular location, is configured to determine a distance that the evaluating device has traveled between a most recent position marker of said position markers sensed by the position-marker sensor and a position of the particular acceleration sensed by the evaluation sensor.

9. An evaluating apparatus as set forth in claim 7 wherein said at least one computing device includes:

a local computing device connected adjacent the evaluating-device body and operatively connected to: (a) the accelerometer, for receiving said acceleration data; (b) the position-marker sensor, for receiving said position-marker data; and (c) the distance meter, for receiving said distance data; and a remote computing device remote to the evaluating device configured to receive data from the local computing device including at least said accelerometer data, said position-marker data, and said distance data and determine said particular location of the evaluating device based on the accelerometer data, the position-marker data, and the distance data.

10. An evaluating apparatus as set forth in claim 9 wherein:

the position-marker data includes information identifying a most recent position marker sensed by the position-marker sensor at the particular time of the particular acceleration;

the distance data includes particular distance data corresponding to a distance traveled by the evaluating device between the most recent position marker and said particular location; and the local computing device includes memory and is configured to store the particular acceleration data, the particular marker data, and the particular distance data so that these particular data are associated together in the memory.

11. An evaluating apparatus in claim 10 wherein the remote computing device is configured to:

store layout data about the package-handling system or a facility or area in which the system is positioned; and determine a specific location of the evaluating device within the package-handling system, the facility, or the area at which the particular acceleration was sensed by the evaluating device by processing information about said particular location and said layout data.

12. An evaluating apparatus as set forth in claim 7 wherein the apparatus is configured so that the computing device stores acceleration data only for accelerations having magnitudes being at or above a preselected acceleration magnitude.

13. An evaluating apparatus as set forth in claim 1 wherein:

each position marker includes a bar code containing information about at least one characteristic selected from a group of characteristics consisting of an identify of the respective marker and a location of the respective marker; and the position-marker sensor includes a bar code scanner configured to read said bar codes.

14. An evaluating apparatus as set forth in claim 1 wherein each position marker includes a radio-frequency identification tag and the position-marker sensor includes a radio-frequency identification scanner.

15. An evaluating apparatus as set forth in claim 1 wherein:

the apparatus is arranged to evaluate a package-handling system having said flow path and transport trays configured for supporting packages as the transport trays and packages are transported together along the flow path through the package-handling system; and the evaluating device is configured to be handled by the package-handling system like the system handles transport evaluating devices loaded with packages during regular operation of the system by generally resembling the loaded transport trays in terms of at least one feature selected from a group of features consisting of: shape, size, and weight.

16. An evaluating apparatus as set forth in claim 1 wherein:

the distance meter is configured to output a signal including pulses wherein each pulse corresponds to a distance traveled by the evaluating device; and the at least one computing device, in being configured to determine said particular location, is programmed with a pulse-to-distance correlation, based on a calibration of the distance meter, and configured to determine a distance traveled by the evaluating device based on a number of pulses received.

17. A method for evaluating an item-transport system utilizing an evaluating apparatus including one or more position markers positioned adjacent a flow path of the item-transport system, an evaluating device including at least one evaluation sensor and a position-marker sensor, a distance meter, and at least one computing device, the method comprising:

transporting the evaluating device along the flow path through the item-transport system;

sensing the position markers utilizing the position-marker sensor as the evaluating device is transported along the flow path to produce position-marker data;

measuring at least one parameter selected from a group of parameters consisting of distance traveled by the evaluating device and speed of the evaluating device utilizing the distance meter and producing distance data based on the measured parameter;

sensing one or more conditions associated with the item-transport system utilizing the evaluation sensor and producing evaluation-sensor data based on the conditions sensed; and determining in the computing device a particular location of the evaluating device along the flow path of the item-transport system at which a particular condition of said one or more conditions was sensed by considering the distance data, the evaluation-sensor data, and the position-marker data.

18. A method as set forth in claim 17 wherein the distance meter includes an anemometer and wherein producing distance data in the measuring step includes producing pulses corresponding to distance traveled by the evaluating device.

19. A method as set forth in claim 17 wherein determining a particular location of the evaluating device includes determining a distance that the evaluating device has traveled since the position-marker sensor sensed a most recent position marker of said position markers.

20. A method as set forth in claim 17 wherein:

said at least one computing device includes a local computing device positioned on the evaluating device and a remote computing device remote to the evaluating device;

the local computing device includes a memory;

the method further includes:

storing the distance, evaluation-sensor, and position-marker data so that these data are associated together in the memory of the local computing device; and transferring the distance, evaluation-sensor, and position-marker data from the local computing device to the remote computing device; and the determining step is performed in the remote computing device.

21. A method as set forth in claim 20 wherein the remote computing device has layout data about a layout of the item-transport system or a facility or an area in which the system is positioned, and the method further comprises determining a specific location of the evaluating device within the item-transport system, facility, or area, at which the particular acceleration was sensed by the accelerometer by processing information about said particular location and said layout data.

22. A method as set forth in claim 17 further comprising determining whether magnitudes of sensed accelerations are at or above a preselected magnitude.

23. A method as set forth in claim 17 wherein:

each position marker includes a bar code containing information about at least one characteristic selected from a group of characteristics consisting of an identify of the respective marker and a location of the respective marker; and the position-marker sensor includes a bar code scanner; and the step of sensing each position marker includes scanning each bar code utilizing the bar code scanner to obtain the information contained in each bar code.

24. A method as set forth in claim 17 wherein each position marker includes a radio-frequency identification tag and the position-marker sensor includes a radio-frequency identification scanner, and the step of sensing each position marker includes scanning each radio-frequency identification tag utilizing the radio-frequency identification scanner.

25. A method as set forth in claim 17 wherein:

the item-transport system is a package-handling system;

the package-handling system transports transport trays supporting packages during regular operation of the system;

the evaluating device is configured to be handled by the package-handling system like the system handles transport trays loaded with packages by resembling the loaded transport trays generally in terms of at least one feature selected from a group of features consisting of: shape, size, and weight; and the transporting, sensing, measuring, and determining steps are performed during regular operation of the package-handling system.

26. A method as set forth in claim 17 wherein:

the evaluation sensor includes an accelerometer;

the sensing step includes sensing one or more accelerations experienced by the evaluating device utilizing the accelerometer and producing acceleration data based on the accelerations sensed; and the determining step includes determining the particular location of the evaluating device along the flow path of the item-transport system being where a particular acceleration and/or particular accelerations of said one or more accelerations was sensed by considering the distance data, the acceleration data, and the position-marker data.

27. A method as set forth in claim 26 wherein determining a particular location of the evaluating device includes determining a distance on the flow path beyond a particular position marker of said markers that the evaluating device was at when the particular acceleration was sensed.

28. A method as set forth in claim 26 wherein the determining step includes determining whether magnitudes of sensed accelerations are at or above a preselected magnitude and identifying an acceleration determined to be at or above the preselected magnitude as said particular acceleration.

29. A method as set forth in claim 26 wherein the determining step includes determining whether sensed accelerations include one or more certain characteristics and identifying at least one group of accelerations having the certain characteristic(s) as said particular accelerations.

30. A method as set forth in claim 26 further comprising associating the particular acceleration or accelerations with an expected cause of the acceleration(s) based at least in part on previously-evaluated performance of the item-transport system.

31. A method as set forth in claim 26 further comprising inspecting the item-transport system at the particular location.

32. A method as set forth in claim 26 wherein the computer device includes a memory and the method further comprises:

storing in the memory of the computer device acceleration data received from the accelerometer corresponding to a particular acceleration of said sensed accelerations;

storing in the computing device distance data received from the distance meter corresponding to the particular acceleration; and storing in the computer device position-marker data received from the position-marker sensor and corresponding to a most recent position marker passed by the evaluating device.

* * * * *